US006885134B2

(12) United States Patent
Kurashima et al.

(10) Patent No.: US 6,885,134 B2
(45) Date of Patent: Apr. 26, 2005

(54) LIGHT SOURCE

(75) Inventors: Tatsuo Kurashima, Hamamatsu (JP); Keiji Suyama, Hamamatsu (JP); Nobuharu Harada, Hamamatsu (JP); Kouji Makino, Hamamatsu (JP)

(73) Assignee: Hamamatsu Photonics K.K., Shizouka (JP)

( * ) Notice: Subject to any disclaimer, the term of this patent is extended or adjusted under 35 U.S.C. 154(b) by 21 days.

(21) Appl. No.: 10/296,504

(22) PCT Filed: May 18, 2001

(86) PCT No.: PCT/JP01/04175

§ 371 (c)(1),
(2), (4) Date: Jun. 2, 2003

(87) PCT Pub. No.: WO01/91160

PCT Pub. Date: Nov. 29, 2001

(65) Prior Publication Data

US 2004/0032740 A1 Feb. 19, 2004

(30) Foreign Application Priority Data

May 25, 2000 (JP) ..... P2000-155093
May 25, 2000 (JP) ..... P2000-155099

(51) Int. Cl.[7] ..... H01J 1/02
(52) U.S. Cl. ..... 313/46; 313/44; 313/11
(58) Field of Search ..... 313/11, 44, 45, 313/46

(56) References Cited

U.S. PATENT DOCUMENTS 4,910,439 A * 3/1990 El-Hamamsy et al. ..... 315/248

FOREIGN PATENT DOCUMENTS

| | | |
|---|---|---|
| EP | 0 700 073 A2 | 3/1996 |
| JP | 37-22463 | 8/1962 |
| JP | 58-25583 | 6/1983 |
| JP | 07-182910 | 7/1995 |
| JP | 07-288106 | 10/1995 |
| JP | 09-219177 | 8/1997 |
| JP | 2001-216939 | 8/2001 |

* cited by examiner

*Primary Examiner*—Vip Patel
(74) *Attorney, Agent, or Firm*—Morgan Lewis & Bockius LLP

(57) ABSTRACT

In a light source, a heat sink is in contact with a side-on type discharge tube 110. The heat sink is in contact with a peripheral region 110*ws* around an exit window 101*ww* of the discharge tube 110. The heat sink consists of a spring member 101*sp* kept in direct contact with the peripheral region 101*ws*, and a radiating block 101*bl* which connects the spring member 101*sp* to a radiator box 101*bx*. Since materials made by sputtering or the like of electrodes in the discharge tube 110 mostly attach to the peripheral region 101*ws* of side wall 101*w*, it is feasible to decrease the amount of materials attaching to the exit window 101*ww* and, in turn, lengthen the lifetime of the discharge tube. Another light source may be constructed in structure in which the heat sink is in contact with a head-on type discharge tube or in structure in which light is outputted from a projecting portion.

10 Claims, 26 Drawing Sheets

LIGHT SOURCE

TECHNICAL FIELD

The present invention relates to a lamp having a discharge tube such as a deuterium discharge tube, a xenon flash tube, or the like.

BACKGROUND ART

A lamp utilizing the microwave is described in Japanese Patent Application Laid-Open No. 07-182910. The lamp described in the Japanese application is configured to seal a gas in an envelope and irradiate the gas with the microwave to excite the gas, thereby inducing emission of light. The gas contains a fluorine base gas, the fluorine base gas etches the internal surface of the silica glass envelope, and Si impurities made by the etching adhere to the internal surface of the envelope. Then, the lamp described in the Japanese application has a cooling pipe penetrating the interior of the envelope and is arranged to attach the impurities made by the etching with the fluorine gas, to the cooling pipe.

DISCLOSURE OF THE INVENTION

Meanwhile, there are the conventionally known discharge tubes utilizing arc discharge between electrodes. Such discharge tubes are well known. The known side-on discharge tubes include the deuterium discharge tubes, the xenon flash tubes, and so on. The side-on discharge tubes are constructed so that the gas such as deuterium, xenon, or the like is sealed in an envelope with a cylindrical side wall, discharge is induced between a pair of electrodes placed inside the envelope, to emit light from the gas between electrodes, and the light is guided through an exit window of the side wall to the outside.

Since the discharge tubes of this type utilize the discharge between electrodes, they do not have to use the fluorine base gas. Therefore, it has been considered that there occurred no etching of the envelope and no attachment of impurities on the interior surface of the envelope.

However, the intensity of output light also decreases after long-term use in the case of the discharge tubes such as the deuterium discharge tubes, the xenon flash tubes, and so on. This was first considered to be due to deterioration of the cathode. The cathode naturally deteriorates after long-term use, but Inventor et al. discovered that the principal cause of the decrease of light output was not the deterioration of the cathode. Specifically, it was found that the decrease of light output was caused in such a manner that materials were scattered in the envelope by sputtering or the like of the cathode and others with the discharge between electrodes in the discharge tube and attached to the exit window of the envelope. The present invention has been accomplished based on such finding and an object of the invention is to provide a light source succeeding in extending the lifetime of the discharge tube.

The present invention has been accomplished in view of the above problem, and a light source according to the present invention is a light source comprising a discharge tube in which a gas is sealed in an envelope having a cylindrical side wall and in which discharge is induced between a pair of electrodes placed inside the envelope, to emit light from the gas between the electrodes and output the light through an exit window of the side wall to the outside, wherein a heat sink is in contact with a surface of a peripheral region around the exit window.

In this light source, the light is outputted through the exit window of the cylindrical side wall to the outside, and the peripheral region is cooled by the heat sink in contact with the surface of the peripheral region around the exit window. Therefore, the materials made by sputtering or the like of the pair of electrodes constituting the cathode or the anode, mostly attach to the peripheral region of the side wall, which decreases the amount of materials attaching to the exit window.

Preferably, the discharge tube is placed in a radiator box and the radiator box is thermally connected to the heat sink. The discharge tube is placed in the radiator box for stable light emission, and the radiator box is thermally connected to the heat sink, whereby the radiator box efficiently radiates heat absorbed through the heat sink from the discharge tube, to the outside, thereby enhancing the cooling efficiency of the peripheral region.

Preferably, the heat sink comprises a spring member which is elastically deformed to contact the cylindrical side wall. In this case, the spring member urges the cylindrical side wall by elastic deformation of the spring member, so as to increase the degree of adhesion between them.

In the case of a configuration wherein the light source is configured so that one of the electrodes is a cathode of a filament, wherein the other of the electrodes is an anode for collecting thermal electrons generated during energization of the filament, and wherein the gas sealed in the envelope contains deuterium, the discharge tube functions as a deuterium discharge tube. The deuterium discharge tube has a low rate of temperature rise on the surface of the tube, different from the xenon lamps filled with xenon under high pressure. In the lamp of this configuration, the temperature difference is smaller between the cooled region by the heat sink and the non-cooled region than in the xenon lamps, which can suppress the deterioration of the side wall due to the temperature difference.

Another light source according to the present invention is a light source comprising a discharge tube in which a gas is sealed in an envelope and in which discharge is induced between a pair of electrodes placed inside the envelope, to emit light from the gas between the electrodes and output the light through an exit window located in a top region of the envelope, to the outside, wherein a heat sink is in contact with a surface of a peripheral region around the exit window.

In this light source, the light is outputted through the exit window to the outside, and the peripheral region is cooled by the heat sink in contact with the surface of the peripheral region around the exit window. Accordingly, the materials made by sputtering or the like of the pair of electrodes constituting the cathode or the anode, mostly attach to the peripheral region, which decreases the amount of materials attaching to the exit window.

Preferably, the heat sink is in contact with the envelope so that the peripheral region is located at least in the top region of the envelope. In this case, the exit window and the peripheral region both are located in the top region of the envelope, so as to efficiently suppress the adhesion of the materials to the exit window.

Preferably, the heat sink is in contact with the envelope so that the peripheral region is also located on a side wall of the envelope. In this case, the side wall is also cooled, so that the adhesion of the materials to the exit window can be suppressed more efficiently. When the heat sink is arranged as a unit in contact with both the top region and the side wall, the heat sink can cover the top region of the envelope, and the contact surface of the heat sink with the side wall can regulate movement of the heat sink in the directions normal to the tube axis of the discharge tube.

The discharge tube has a stem constituting a bottom region of the envelope and the stem is fixed to the heat sink through a plurality of bolts extending in parallel with the axis of the tube. In this case, the stem is utilized for fixing of the heat sink, and it is thus feasible to suppress increase in the number of components necessary for the fixing.

When the peripheral region is set on the surface of the side wall of the discharge tube so as to surround the tube axis of the discharge tube, the heat sink can cool the discharge tube so as to surround the side wall. In addition, when the heat sink is arranged as a unit to surround the side wall, it is feasible to regulate movement of the heat sink in the directions normal to the tube axis.

In the case of a configuration wherein one of the electrodes is a cathode of a filament, wherein the other of the electrodes is an anode for collecting thermal electrons generated during energization of the filament, and wherein the gas sealed in the envelope contains deuterium, the discharge tube functions as a deuterium discharge tube. The deuterium discharge tube has a low rate of temperature rise on the surface of the tube, different from the xenon lamps filled with xenon under high pressure. In the lamp of this configuration, the temperature difference is smaller between the cooled region by the heat sink and the non-cooled region than in the xenon lamps, which can suppress the deterioration of the envelope due to the temperature difference.

Another light source according to the present invention is a light source comprising a discharge tube in which a gas is sealed in an envelope and in which discharge is induced between a pair of electrodes placed inside the envelope, to emit light from the gas between the electrodes and output the light through an exit window located at a distal end of a projecting portion communicating with a predetermined portion of the envelope, to the outside, wherein a heat sink is in contact with a peripheral region around the predetermined portion or a surface except for the exit window of the projecting portion.

In this light source, the light is outputted through the exit window located at the distal end of the projecting portion extending from the predetermined portion, to the outside, and the peripheral region is cooled by the heat sink in contact with the peripheral region of the predetermined portion or the surface except for the exit window of the projecting portion. Accordingly, the materials made by sputtering or the like of the pair of electrodes constituting the cathode or the anode, mostly attach to the peripheral region of the side wall, so as to decrease the amount of materials attaching to the exit window.

BEST MODE FOR CARRYING OUT THE INVENTION

The light sources as embodiments will be described below. The same elements will be denoted by the same reference symbols, and redundant description will be omitted.

(First Embodiment)

Figure 1:
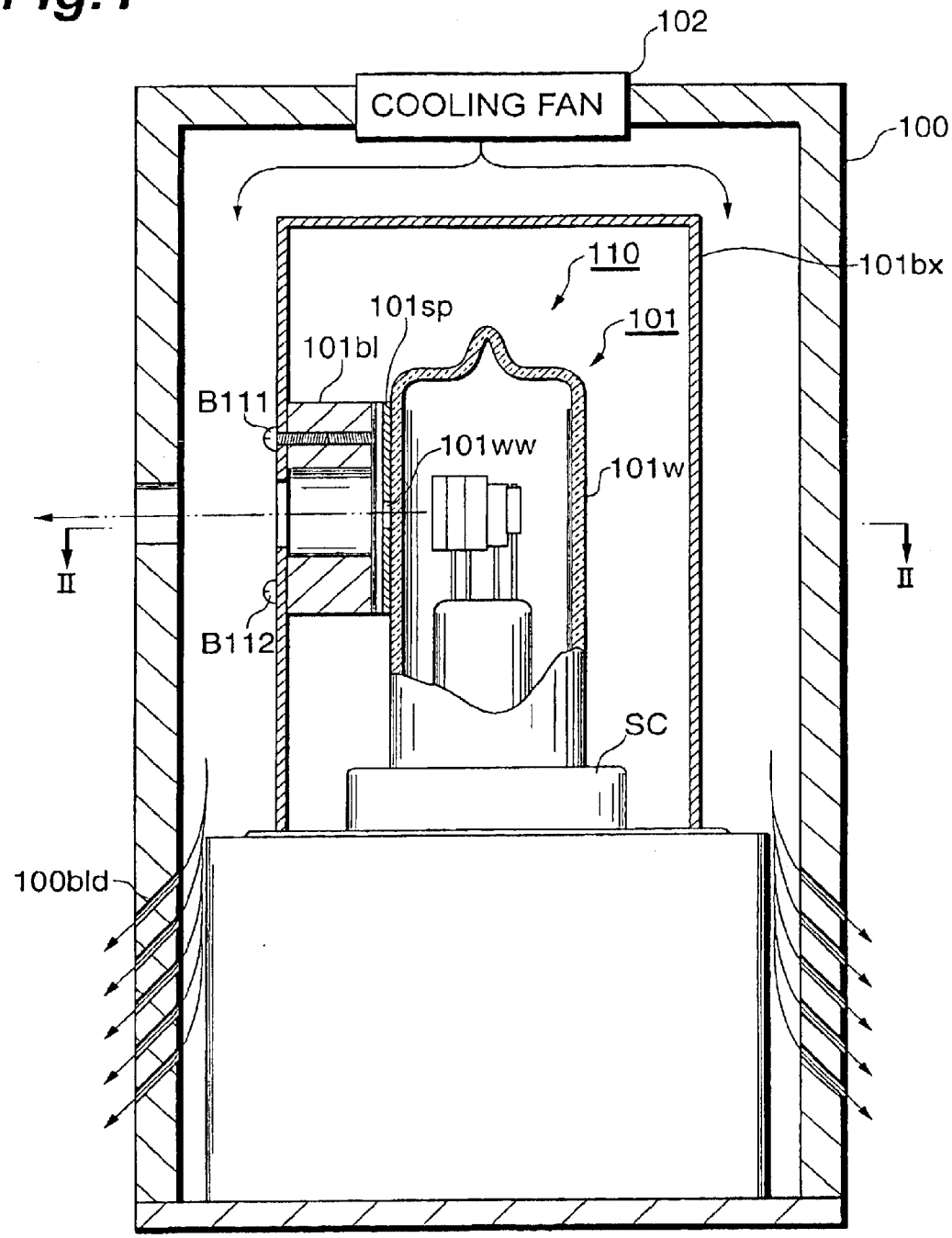
FIG. 1 is a longitudinal sectional view of the light source as a first embodiment.
Figure 2:
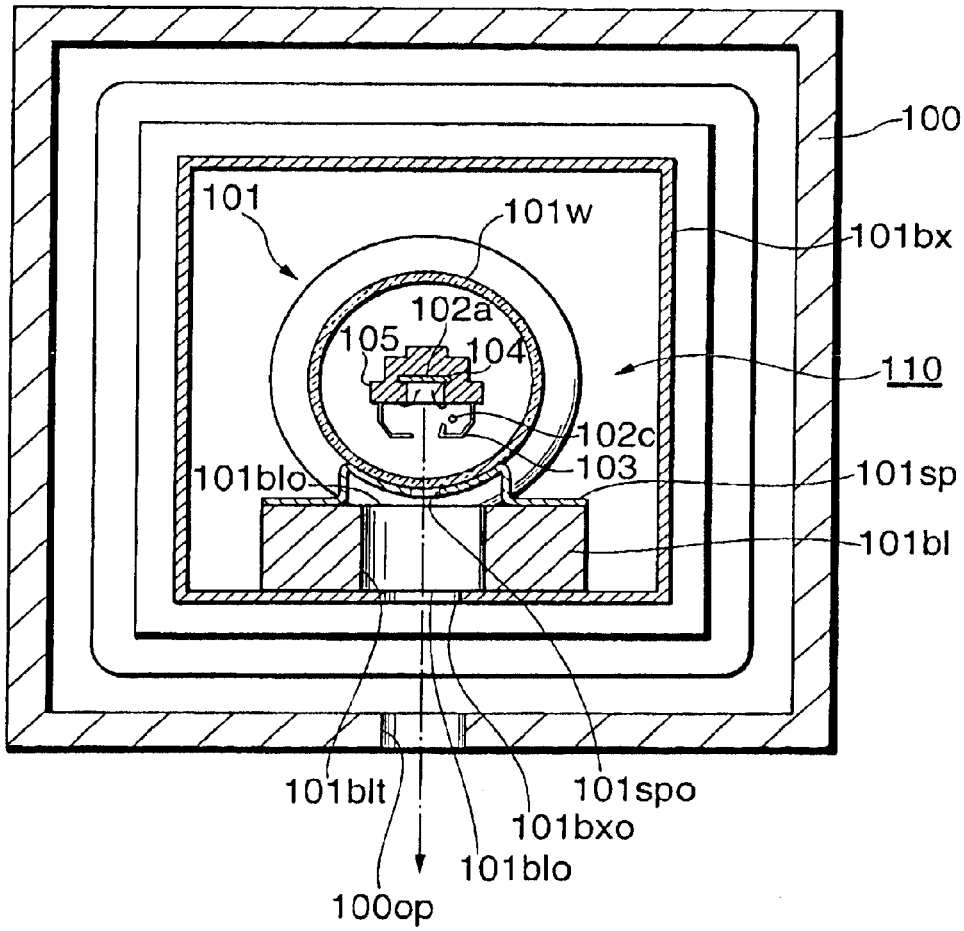
FIG. 2 is a sectional view along a line II—II with arrows of the light source shown in FIG. 1.
Figure 3:
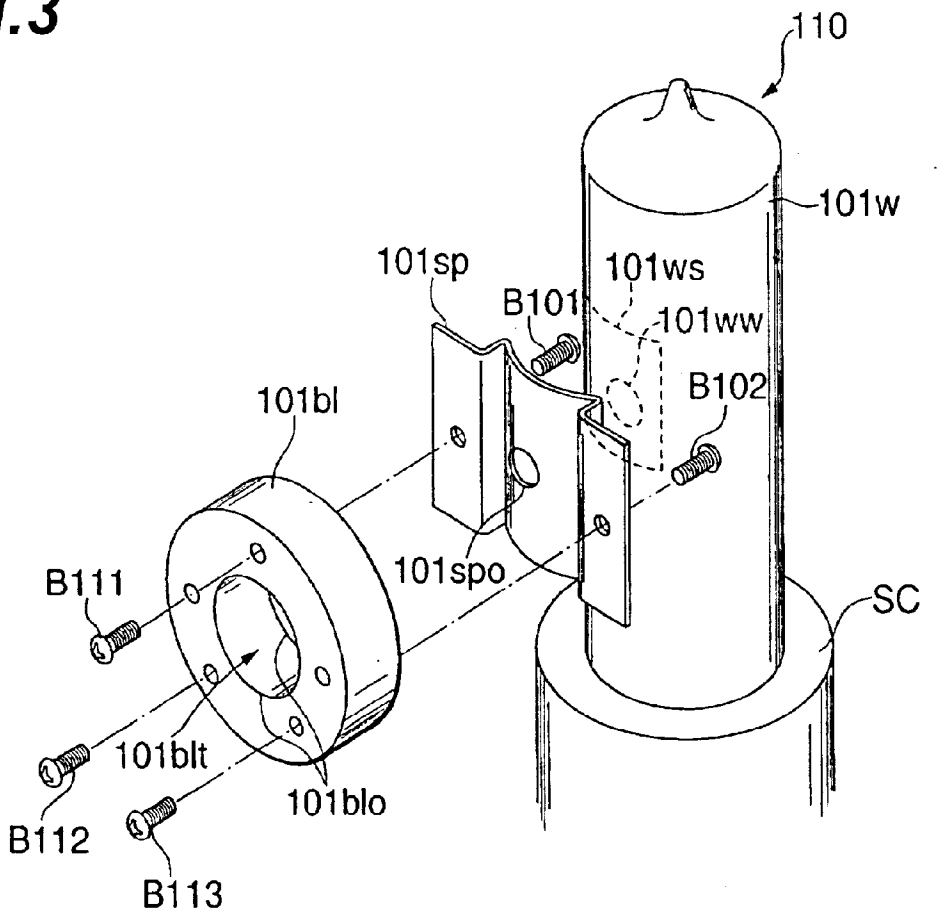
FIG. 3 is a perspective view of major part of the light source shown in FIG. 1.

FIG. 1 is a longitudinal sectional view of the light source as a first embodiment, FIG. 2 a sectional view along a line II—II with arrows of the light source shown in FIG. 1, and FIG. 3 a perspective view of major part of the light source shown in FIG. 1.

The light source of the present embodiment comprises an outer box 100, an inner box (radiator box) 101*bx* housed in the outer box 100, and a discharge tube 110 placed in the inner box 101*bx*. The discharge tube 110 is mounted on a socket SC fixed to a bottom plate of the inner box 101*bx*, and the exterior surface of the inner box 101*bx* is cooled by a cooling fan 102 disposed in the top region of the outer box 100. Air taken in from the cooling fan 102 flows through vent holes 100*bld* formed in the side wall of the outer box 100, to the outside.

The discharge tube 110 comprises an airtight envelope (glass bulb) 101 having a cylindrical side wall 101*w*. A gas such as deuterium or the like is sealed in the envelope 101 so as to emit ultraviolet light as output light. When discharge is induced between a pair of electrodes 102*c*, 102*a* placed inside the envelope 101, light is emitted from the gas between the electrodes 102*c*, 102*a* and is outputted through an exit window 101*ww* in the side wall 101*w* to the outside.

A heat sink consisting of a radiating block 101*bl* and a radiating spring member 101*sp* is in contact with a surface of peripheral region 101*ws* around the exit window 101*ww*. The discharge tube 110 is placed inside the radiator box 101*bx* and the outer box 100 for stable light emission, and the radiator box 101*bx* is thermally connected to the heat sink 101*sp*, 101*bl*, whereby the radiator box 101*bx* absorbs heat through the heat sink 101*sp*, 101*bl* from the discharge tube 110 and efficiently radiates the heat to the outside, thus increasing the cooling efficiency of the peripheral region 101*ws*.

The radiating spring member 101*sp* will be described below in detail. The spring member 101*sp* has an inwardly concave cylindrical surface, which is in contact with the surface of the peripheral region 101*ws* constituting an outwardly convex cylindrical surface. The radius of curvature of the cylindrical surface of the spring member 101*sp* in a no-load state is larger than that of the side wall 101*w* of the discharge tube, and the spring member 101*sp* is elastically deformed so as to decrease the radius of curvature thereof when the spring member 101*sp* is pressed against the side wall 101*w*. In the elastically deformed state, the two ends of the spring member 101*sp* in the direction along the curvature thereof hold the side face 101*w* between and the center portion of the curvature urges the side face 101*w* in the direction normal to the tube axis of the discharge tube 110. The bottom part of the discharge tube 110 is fixed to the socket SC and the spring member 101*sp* urges the side face 101*w* everywhere, which increases the degree of adhesion between the spring member 101*sp* and the peripheral region 101*ws* of the cylindrical side wall.

The spring member 101*sp* has an opening 101*spo* through which the output light from the discharge tube 110 passes, and the radiating block 101*bl* has two parallel planes facing each other, and a light-passing through hole 101*blt* penetrating the block 101*bl* so as to establish communication between openings 101*blo* formed in these two planes. Accordingly, the radiating block 101*bl* is of such ring shape as to surround the through hole 101*blt*. Furthermore, the inner box 101*bx* has a light-exiting opening 101*bxo* in its side wall.

The spring member 101*sp* and the ring radiating block 101*bl* are fixed to each other with bolts B101, B102 so that their respective openings 101*spo*, 101*blo* are aligned with each other. The radiating block 101*bl* and the interior surface of the side wall of the inner box 101*bx* are fixed to each other with bolts B111, B112, B113 so that their respective openings 101*blo*, 101*bxo* are aligned with each other. These openings 101*blo*, 101*bxo* are aligned with an opening 100*op* provided in the side wall of the outer box 100.

In the light source, the light is outputted through the exit window 101*ww* of the cylindrical side wall 101*w* to the outside of the discharge tube, and the light in the discharge tube 110 is outputted through the openings 101*spo*, 101*blo*, 101*bxo*, 100*op* to the outside of the outer box 100. Since the heat sink is in contact with the surface of the peripheral region 101*ws* around the exit window 101*ww*, the peripheral region 101*ws* is cooled. Accordingly, the materials made by sputtering or the like of the electrode 102*c* for the cathode or the electrode 102*a* for the anode, mostly attach to the peripheral region 101*ws* of the side wall 101*w*, so as to decrease the amount of materials attaching to the exit window 101*ww*. Namely, the exit window 101*ww* is kept clean over a long period of time, so that the lifetime of the discharge tube can be extended.

The discharge tube 110 is conventionally known, and it will be briefly described with reference to FIG. 2. Inside the envelope 101 having the side wall 101*w*, as described above, there are the two electrodes 102*c*, 102*a*, one of which is the cathode 102*c* of a filament and the other of which is the anode 102*a* for collecting thermal electrons generated during energization of the filament 102*c*. The filament 102*c* is placed inside a metal shield 103 surrounding it, and the thermal electrons generated at the filament 102*c* travel through an opening of the shield 103 and toward a converging electrode 104 and are curved in trajectory by the shield 103 and converging electrode 104 to impinge on the anode 102*a*. The shield 103 is mounted on the light exit side of an insulator 105, and the anode 102*a* on the light entrance side of the insulator 105. Thus the shield 103 and the anode 102*a* are insulated from each other, and the shield 103 and the filament 102*c* are also insulated from each other.

When the gas sealed in the envelope 101 contains deuterium, the discharge tube 110 functions as a deuterium discharge tube. The deuterium discharge tube has a low rate of temperature rise on the surface of the tube, different from the xenon lamps filled with xenon under high pressure. In the lamp of the foregoing configuration the temperature difference is smaller between the cooled region 101*ws* by the heat sink and the non-cooled region 101*ww* than in the xenon lamps, which suppresses the deterioration of the side wall 101*w* due to the temperature difference.

The present invention can also be applied to the xenon flash tubes and mercury xenon tubes with xenon in the envelope 101, and the electrode 102*c* does not always have to be the filament.

As described above, the materials made by sputtering or the like of the electrode 102*c* for the cathode or the electrode 102*a* for the anode, mostly attach to the peripheral region 101*ws* of the side wall 101*w*, so that the exit window 101*ww* is kept clean over a long period of time, so as to lengthen the lifetime of the discharge tube. We measured variation per hour of relative light output for the above light source with the radiating block (example) and the light source without it (comparative example).

Figure 4:
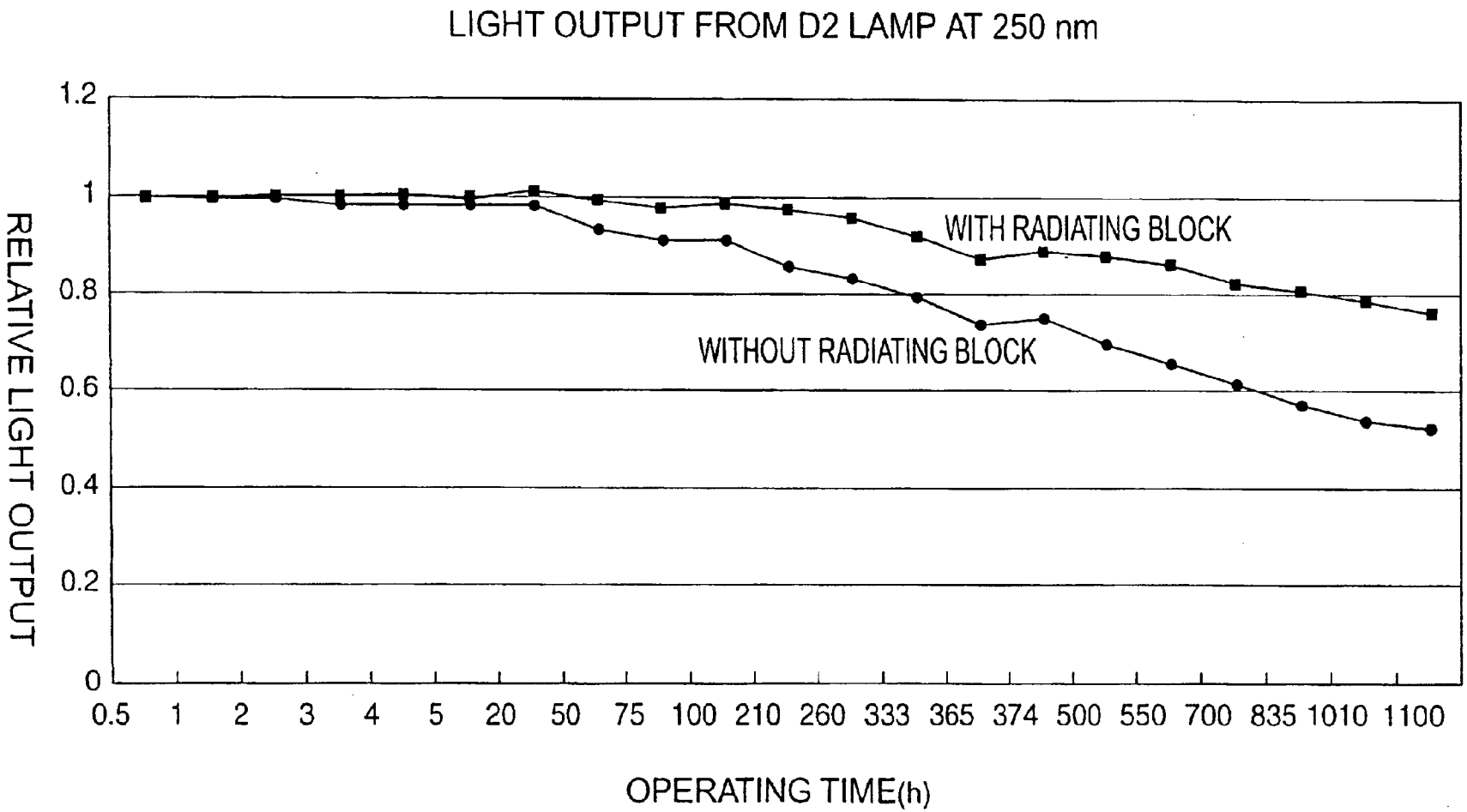
FIG. 4 is a graph showing the relation between operating time (hour) and relative light output (at the measured wavelength: 250 nm) of the light sources as an example and a comparative example.
Figure 5:
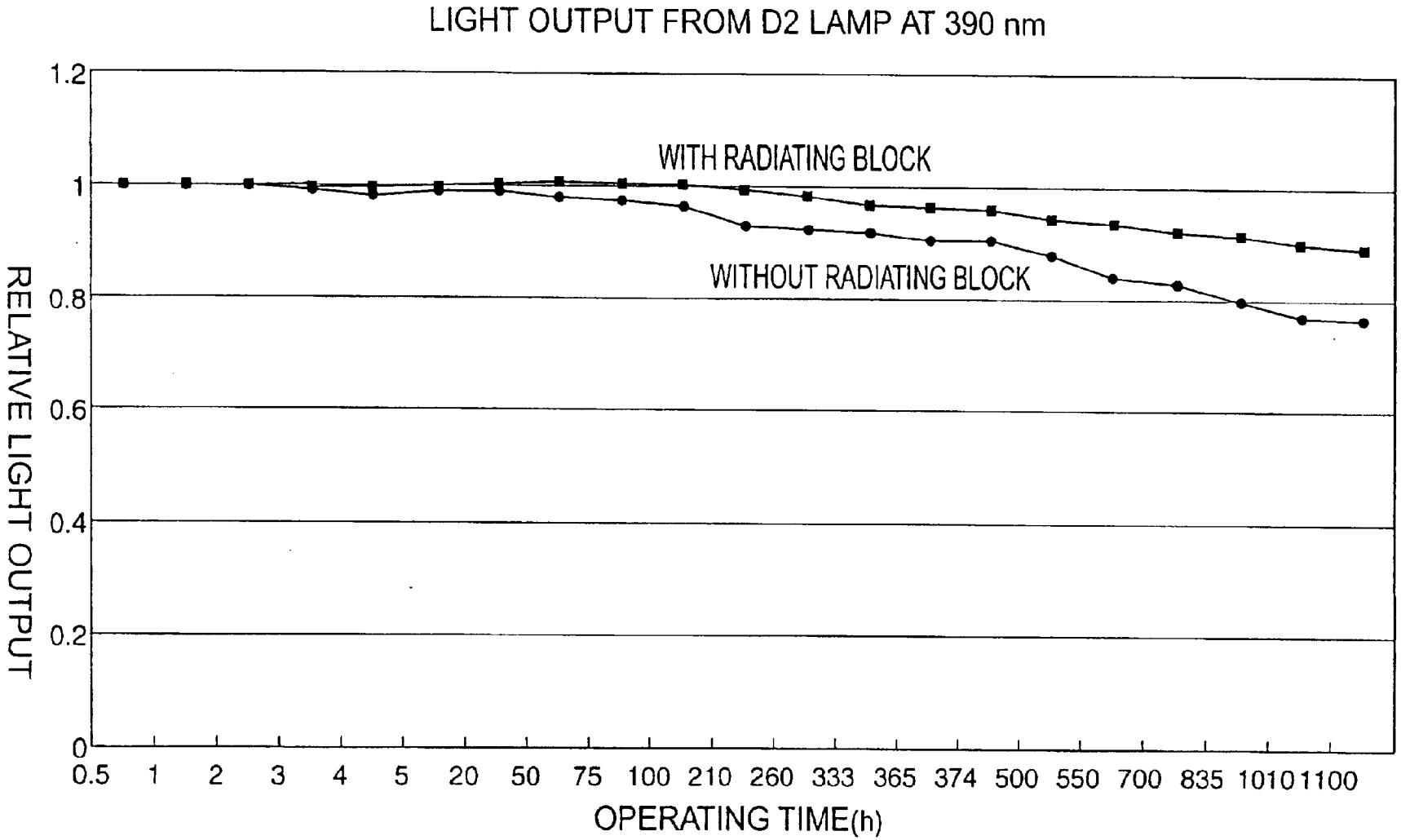
FIG. 5 is a graph showing the relation between operating time (hour) and relative light output (at the measured wavelength: 390 nm) of the light sources as an example and a comparative example.

FIG. 4 and FIG. 5 are graphs showing the relations between operating time (hour) and relative light output (at the measured wavelength: 250 nm and 390 nm) of these light sources. As seen from these graphs, the decreasing rate of relative light output of the light source with the radiating block is not more than 5% over 100 hours of relative light output, so as to achieve extension of the lifetime to one extremely longer than that of the light source without it. The numerical data is presented in Table 1 and Table 2 below.

TABLE 1

| | time (hour) | | | | | | | |
|---|---|---|---|---|---|---|---|---|
| | 0.5 | 1 | 2 | 3 | 4 | 5 | 20 | 50 |
| 250 nm without radiating blook | 1 | 0.996 | 0.998 | 0.985 | 0.984 | 0.984 | 0.985 | 0.935 |
| 250 nm with radiating block | 1 | 1.000 | 1.008 | 1.009 | 1.011 | 1.009 | 1.018 | 0.993 |

| | time (hour) | | | | | | | |
|---|---|---|---|---|---|---|---|---|
| | 75 | 100 | 210 | 260 | 333 | 365 | 374 | 500 |
| 250 nm without radiating block | 0.914 | 0.912 | 0.859 | 0.832 | 0.794 | 0.738 | 0.748 | 0.697 |
| 250 nm with radiating block | 0.981 | 0.986 | 0.973 | 0.955 | 0.923 | 0.876 | 0.893 | 0.879 |

| | time (hour) | | | | |
|---|---|---|---|---|---|
| | 550 | 700 | 835 | 1010 | 1100 |
| 250 nm without radiating block | 0.658 | 0.611 | 0.570 | 0.535 | 0.519 |
| 250 nm with radiating block | 0.865 | 0.825 | 0.812 | 0.787 | 0.764 |

TABLE 2

| | time (hour) | | | | | | | |
|---|---|---|---|---|---|---|---|---|
| | 0.5 | 1 | 2 | 3 | 4 | 5 | 20 | 50 |
| 390 nm without radiating black | 1 | 0.999 | 1.000 | 0.994 | 0.996 | 0.997 | 1.000 | 0.985 |
| 390 nm with radiating block | 1 | 0.989 | 1.001 | 1.001 | 1.002 | 1.002 | 1.003 | 1.008 |

| | time (hour) | | | | | | | |
|---|---|---|---|---|---|---|---|---|
| | 75 | 100 | 210 | 269 | 333 | 365 | 374 | 500 |
| 390 nm without radiating block | 0.979 | 0.973 | 0.937 | 0.930 | 0.923 | 0.908 | 0.909 | 0.885 |
| 390 nm with radiating block | 1.008 | 1.007 | 0.994 | 0.986 | 0.973 | 0.970 | 0.968 | 0.948 |

| | time (hour) | | | | |
|---|---|---|---|---|---|
| | 550 | 700 | 835 | 1010 | 1100 |
| 390 nm without radiating block | 0.864 | 0.835 | 0.802 | 0.774 | 0.769 |

TABLE 2-continued

| | | | | | |
|---|---|---|---|---|---|
| 390 nm with radiating block | 0.941 | 0.928 | 0.916 | 0.906 | 0.895 |

Figure 6:
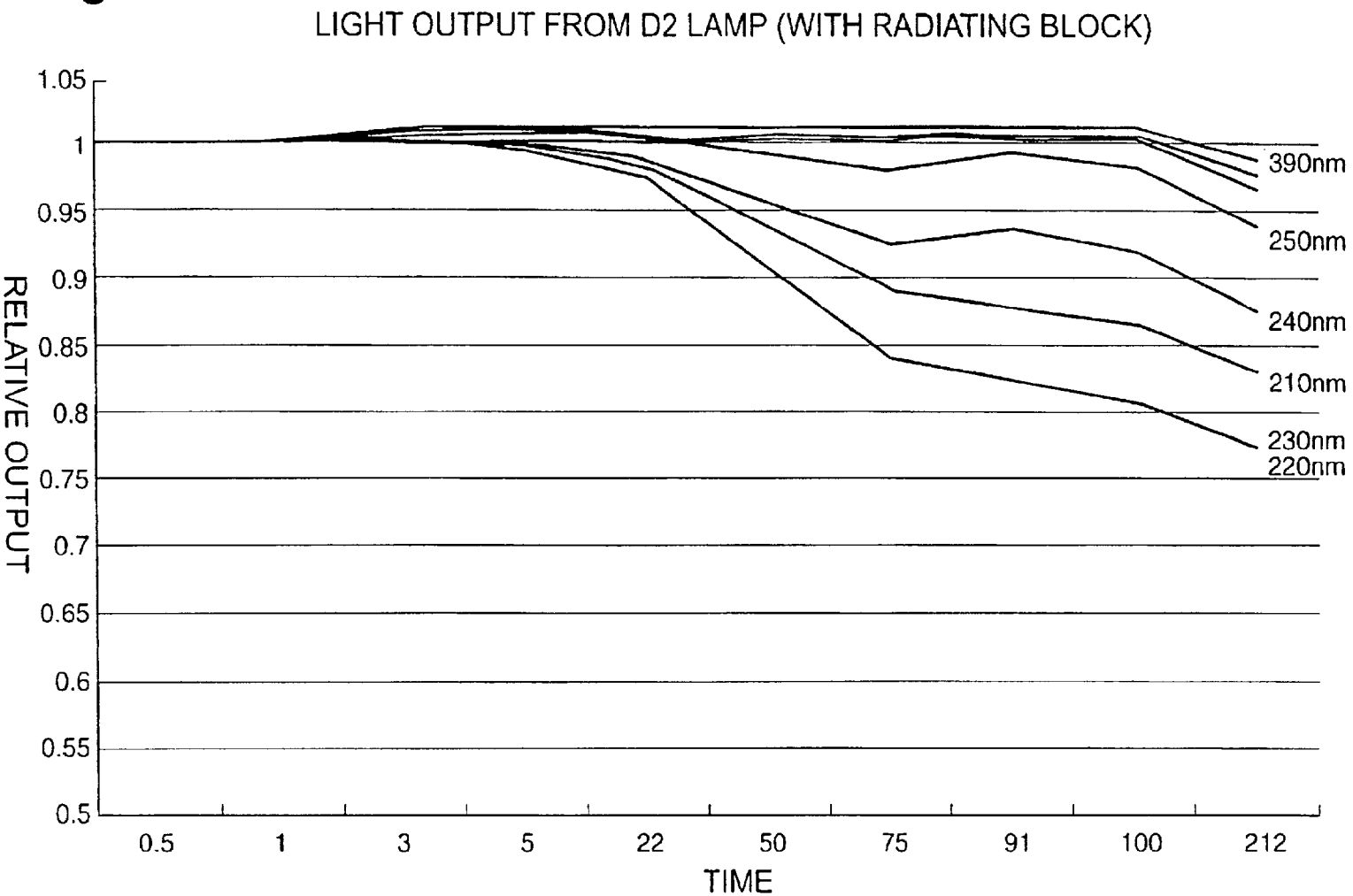
FIG. 6 is a graph showing the relation between operating time (hour) and relative light output of the light source as an example.
Figure 7:
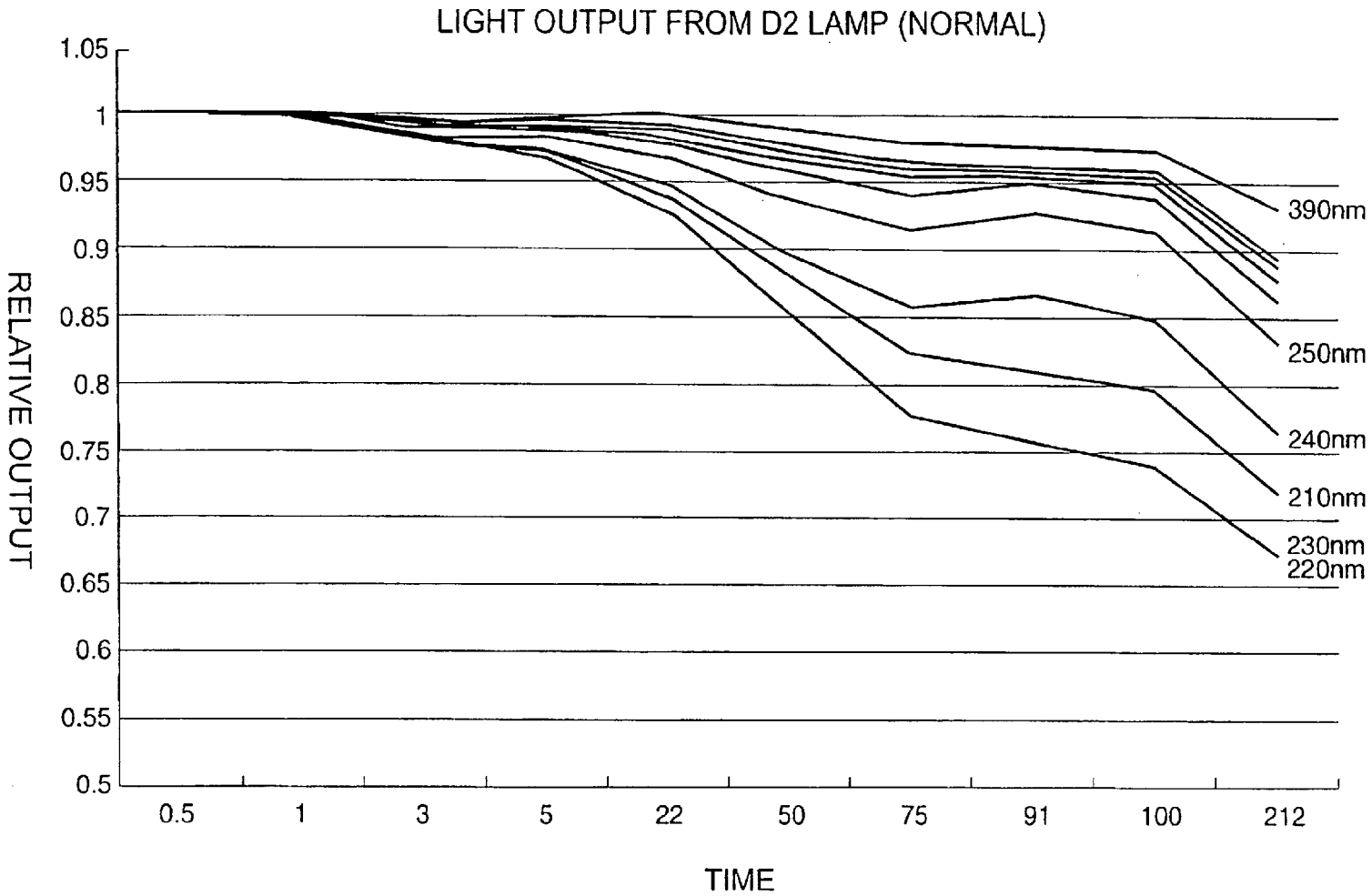
FIG. 7 is a graph showing the relation between operating time (hour) and relative light output of the light source as a comparative example.

FIG. 6 and FIG. 7 are graphs showing the relations between operating time (hour) and relative light output of the light sources of the example and the comparative example, respectively. As seen from these graphs, the light source of the example demonstrates smaller decreases per hour of relative light output than the light source of the comparative example, at all the wavelength components of 220 nm–390 nm. As described above, the foregoing light source succeeded in lengthening the lifetime of the discharge tube thereof.

(Second Embodiment)

Figure 8:
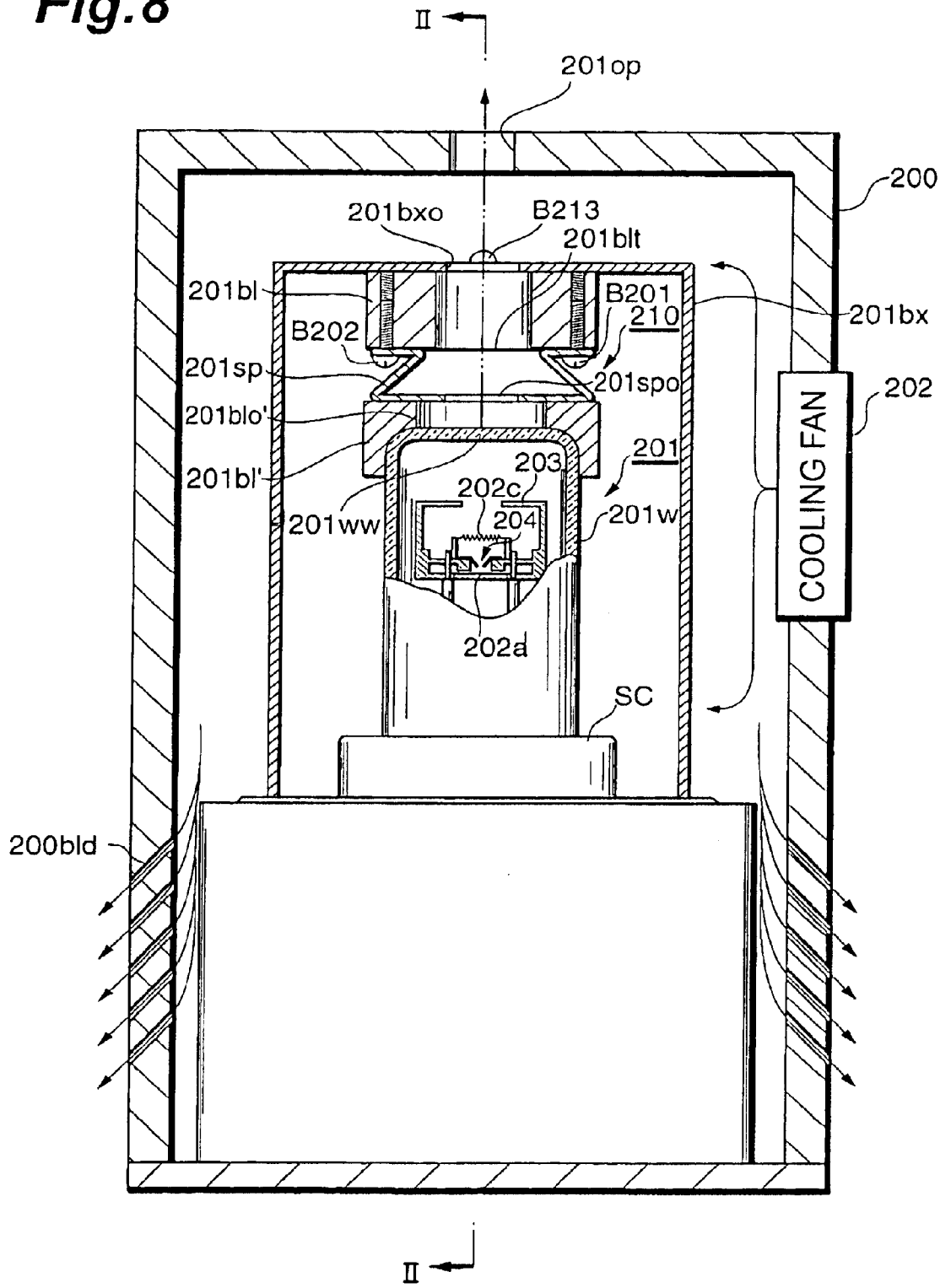
FIG. 8 is a longitudinal sectional view of the light source as a second embodiment.
Figure 9:
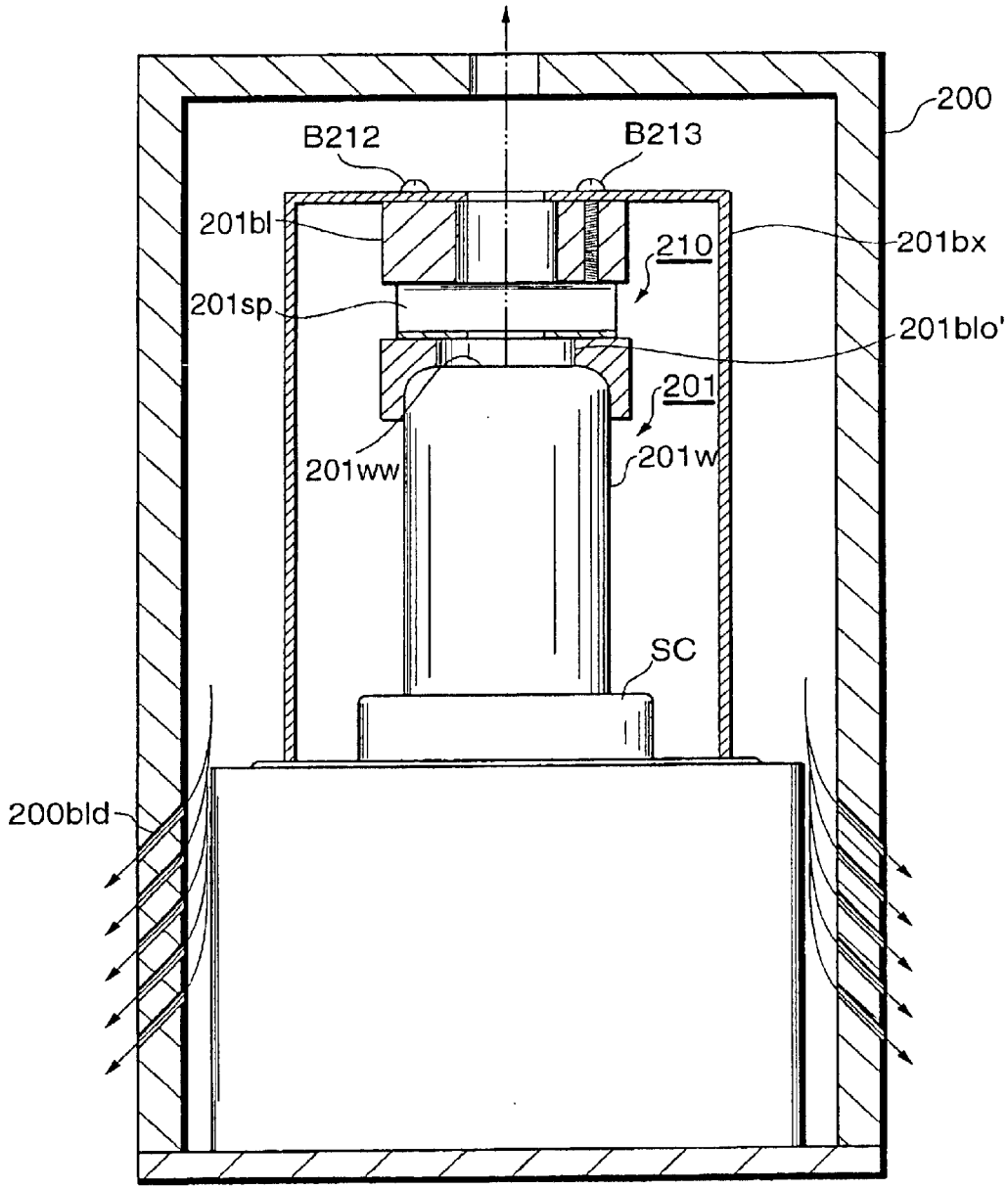
FIG. 9 is a sectional view along a line II—II with arrows of the light source shown in FIG. 8.
Figure 10:
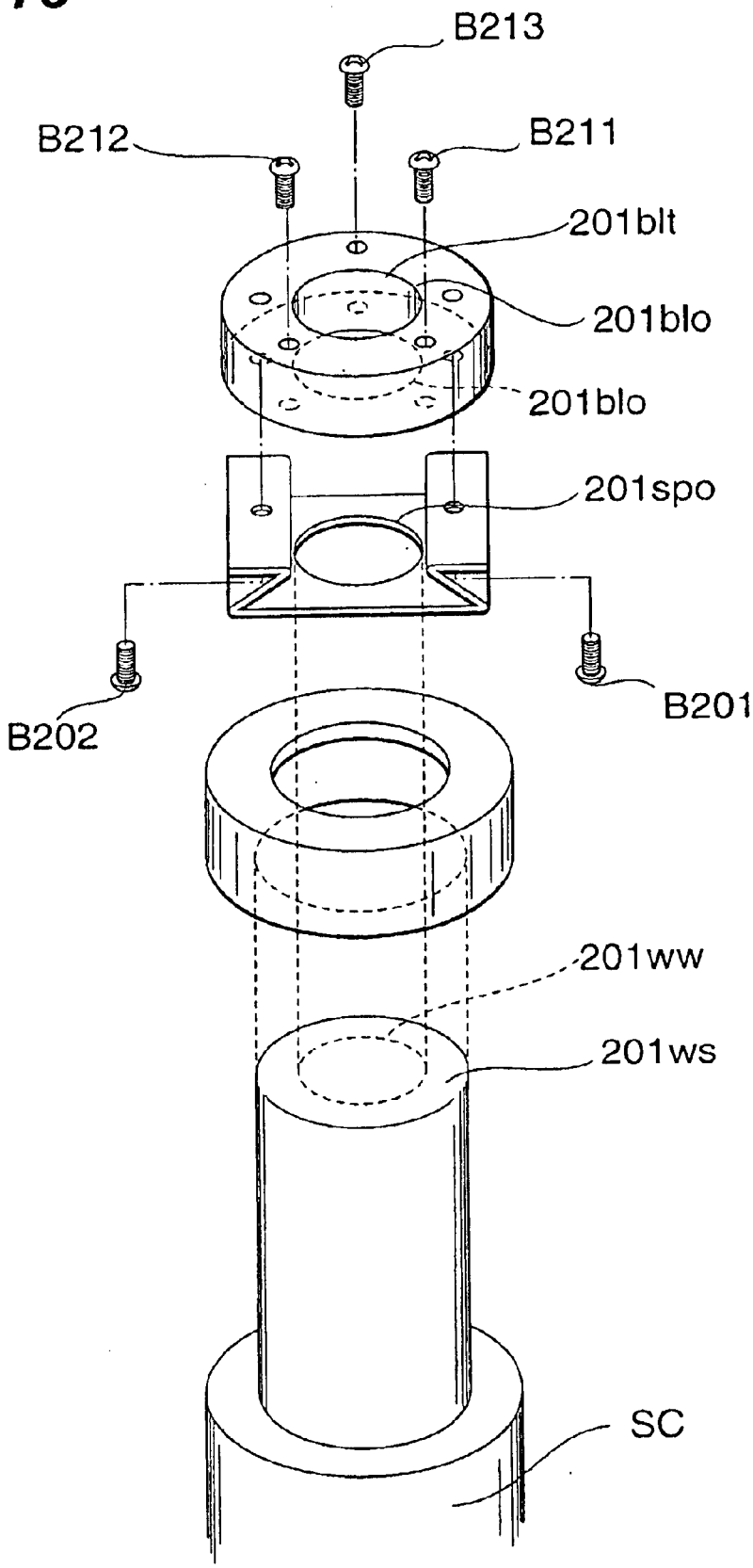
FIG. 10 is a perspective view of major part of the light source shown in FIG. 8.

FIG. 8 is a longitudinal sectional view of the light source as a second embodiment, FIG. 9 a sectional view along a line II—II with arrows of the light source shown in FIG. 8, and FIG. 10 a perspective view of major part of the light source shown in FIG. 8.

The light source of the present embodiment comprises an outer box 200, an inner box (radiator box) 201*bx* housed in the outer box 200, and a discharge tube 210 placed in the inner box 201*bx*. The discharge tube 210 is mounted on a socket SC fixed to a bottom plate of the inner box 201*bx*, and the exterior surface of the inner box 201*bx* is cooled by a cooling fan 202 disposed in the side wall of the outer box 200. Air taken in from the cooling fan 202 flows through vent holes 200*bld* formed in the side wall of the outer box 200, to the outside.

The deuterium discharge tubes can suffer degradation of stability of light output because of fluctuation of outside air temperature, whereas the present embodiment is configured to let air flow between the inner box 201*bx* and the outer box 200 so as to avoid the flowing air directly hitting the deuterium discharge tube, thereby preventing the degradation of stability of output.

The discharge tube 210 comprises an airtight envelope (glass bulb) 201 having a cylindrical side wall 201*w*. A gas such as deuterium or the like is sealed in the envelope 201 so as to emit ultraviolet light as output light. When discharge is induced between a pair of electrodes 202*c*, 202*a* placed inside the envelope 201, light is emitted from the gas between the electrodes 202*c*, 202*a* and is outputted through an exit window 201*ww* located in the top region of the envelope 201, to the outside.

A heat sink consisting of radiating blocks 201*bl*, 201*bl*', and a radiating spring member 201*sp* is in contact with a surface of peripheral region 201*ws* around the exit window 201*ww*. The discharge tube 210 is located inside the radiator box 201*bx* and the outer box 200 for stable light emission, and the radiator box 201*bx* is thermally connected to the heat sink 201*bl*', 201*sp*, 201*bl*, whereby the radiator box 201*bx* absorbs heat through the heat sink 201*bl*', 201*sp*, 201*bl* from the discharge tube 210 and efficiently radiates the heat to the outside, so as to increase the cooling efficiency of the peripheral region 201*ws*.

The radiating block 201*bl*' kept in direct contact with the discharge tube 210 is of such shape as to cover the top region of the envelope 201 of the discharge tube 210. The exterior surface of the top region of the envelope 201 consists of a circular surface and a cylindrical side face extending continuously from the outer periphery of the circular surface and in the direction normal to the circular surface by approximately 20% or less of the tube length. A region in a predetermined radius from the center of the circular surface is not in contact with the radiating block 201*bl*', and this region functions as an exit window 201*ww*. Namely, the center region of the ring-shaped radiating block 201*bl*' constitutes a through hole 201*blo*' extending in parallel with the tube axis, the discharge-tube-side end of the through hole 201*blo*' located inside the radiating block 201*bl*' is in contact with the aforementioned peripheral region around the above circular surface, the diameter thereof expands from the contact position to the diameter of the envelope, and the edge then extends in parallel with the tube axis.

The radiating spring member 201*sp* will be described below in detail. The spring member 201*sp* consists of a flat portion in contact with an opening end face of the radiating block 201*bl*'; transition portions bent to stand so as to decrease the width from the two width-directional ends of the flat portion toward the radiating block 201*bl*; and fixing portions bent to increase the width at contact positions of the transition portions with the radiating block 201*bl*. The fixing portions of the spring member 201*sp* are fixed to the radiating block 201*bl* with bolts B201, B202, and the radiating block 201*bl* is fixed to the interior surface of the radiator box 201*bx* with bolts B211, B212, B213.

The spring member 201*sp* is slightly extended in the direction parallel to the tube axis in a no-load state, and the spring member 201*sp* is elastically deformed to be compressed so as to urge the radiating block 201*bl*' when the spring member 201*sp* is pressed against the radiating block 201*bl*' along the tube axis. Accordingly, the degree of adhesion is enhanced between the spring member 201*sp* and the radiating block 201*bl*'. The spring member 201*sp* has an opening 201*spo* through which the output light from the discharge tube 210 passes.

The radiating block 201*bl* has two parallel planes facing each other, and has a light-passing through hole 201*blt* penetrating the block 201*bl* so as to establish communication between openings 201*blo* formed in these two planes. Accordingly, the radiating block 201*bl* is of such ring shape as to surround the through hole 201*blt*. Furthermore, the inner box 201*bx* has a light-exiting opening 201*bxo* in the wall surface.

The spring member 201*sp* and the ring radiating block 201*bl* are fixed to each other so that their respective openings 201*spo*, 201*blo* are aligned with each other. The radiating block 201*bl* and the interior surface of the side wall of the inner box 201*bx* are fixed to each other with the bolts B211, B212, B213 so that their respective openings 201*blo*, 201*bxo* are aligned with each other. These openings 201*blo*, 201*bxo* are aligned with an opening 200*op* provided in the side wall of the outer box 200.

In the light source, the light is outputted through the exit window 201*ww* to the outside of the discharge tube, and the light in the discharge tube 210 is outputted through the openings 201*blo*', 201*spo*, 201*blo*, 201*bxo*, 200*op* to the outside of the outer box 200. Since the heat sink is in contact with the surface of the peripheral region 201*ws* around the exit window 201*ww*, the peripheral region 201*ws* is cooled. Accordingly, the materials made by sputtering or the like of the electrode 202*c* for the cathode or the electrode 202*a* for the anode, mostly attach to the peripheral region 201*ws*, so as to decrease the amount of materials attaching to the exit window 201*ww*. Namely, the exit window 201*ww* is kept clean over a long period of time, so that the lifetime of the discharge tube can be lengthened.

The discharge tube 210 is conventionally known, and it will be briefly described below. Inside the envelope 201, as described above, there are the two electrodes 202*c*, 202*a*, one of which is the cathode 202*c* of a filament and the other of which is the anode 202*a* for collecting thermal electrons generated during energization of the filament 202*c*. The filament 202*c* is placed inside a metal shield 203 surrounding it, and the thermal electrons generated at the filament 202*c* travel toward a converging electrode 204 and are curved in trajectory by the shield 203 and converging electrode 204 to impinge on the anode 202*a*.

When the gas sealed in the envelope 201 contains deuterium, the discharge tube 210 functions as a deuterium discharge tube. The deuterium discharge tube has a low rate of temperature rise on the surface of the tube, different from the xenon lamps filled with xenon under high pressure. In the lamp of the above configuration the temperature difference is smaller between the cooled region 201*ws* by the heat sink and the non-cooled region 201*ww* than in the xenon lamps, which suppresses the deterioration of the envelope 201 due to the temperature difference.

The present invention can also be applied to the xenon flash tubes and mercury xenon tubes with xenon in the envelope 201, and the electrode 202*c* does not always have to be the filament.

As described above, the materials made by sputtering or the like of the electrode 202*c* for the cathode or the electrode 202*a* for the anode, mostly attach to the peripheral region 201*ws*, so that the exit window 201*ww* is kept clean over a long period of time, so as to lengthen the lifetime of the discharge tube.

The above discharge tube was disclosed as a vertical type, but it may also be utilized as a horizontal type. Namely, the tube axis of the discharge tube 210 may be parallel to the vertical direction or parallel to the horizontal direction. The through holes 201*blt*, 201*blo*' may be arranged to expand their diameter with distance from the discharge tube 210, or may be formed in constant diameter, of course. These also apply to the following embodiments.

We measured variation per hour of relative light output for the above light source with the radiating block (example) and the light source without it (comparative example).

Figure 11:
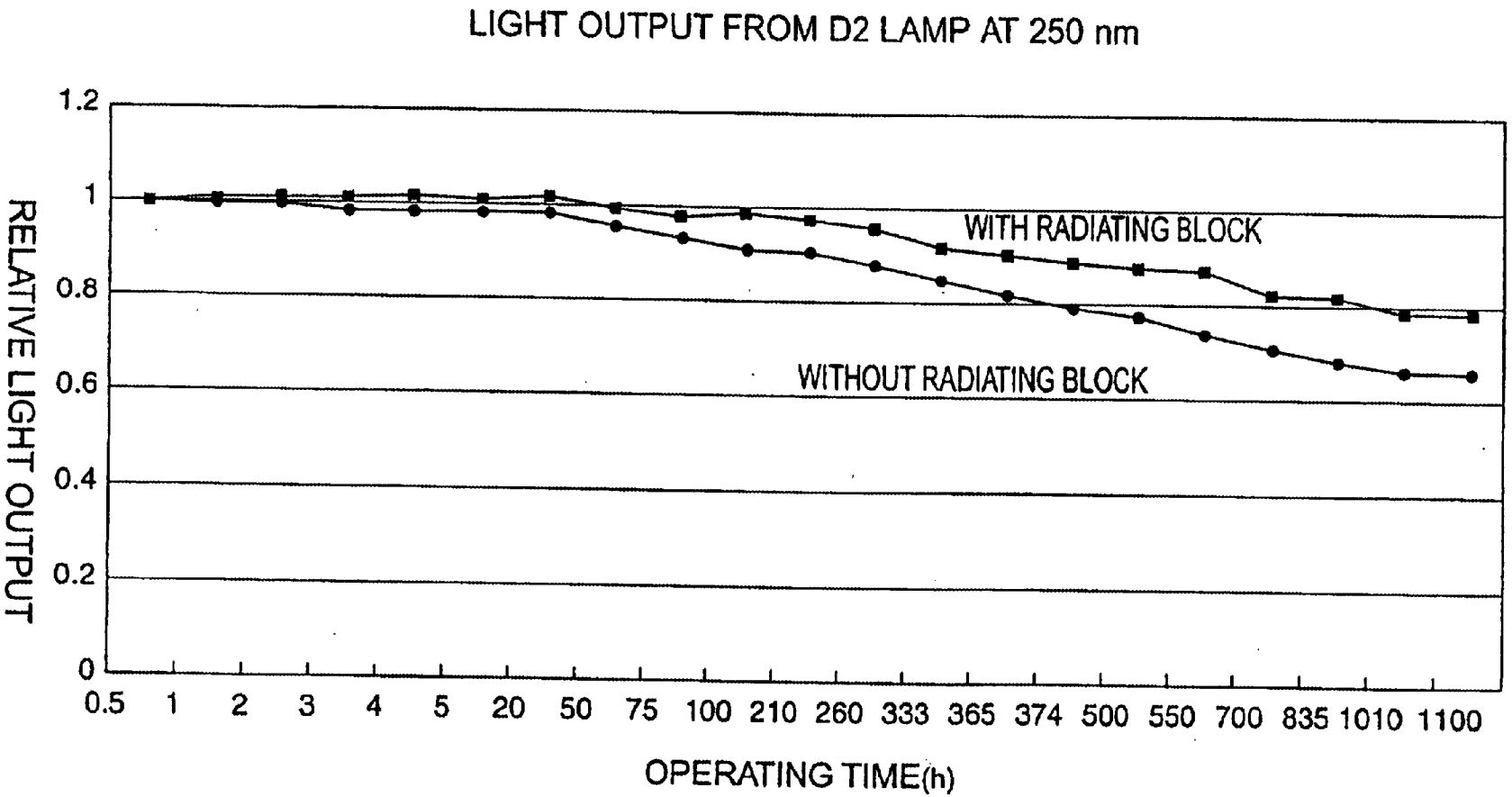
FIG. 11 is a graph showing the relation between operating time (hour) and relative light output (at the measured wavelength: 250 nm) of the light sources.

FIG. 11 is a graph showing the relation between operating time (hour) and relative light output (at the measured wavelength: 250 nm) of these light sources. As seen from these graphs, the decreasing rate of relative light output of the light source with the radiating block is not more than 5% over 100 hours of relative light output, so as to achieve extension of the lifetime to one extremely longer than that of the light source without it. The numerical data is presented in Table 3 below.

TABLE 3

| | time (hour) | | | | | | | |
|---|---|---|---|---|---|---|---|---|
| | 0.5 | 1 | 2 | 3 | 4 | 5 | 20 | 50 |
| 250 nm without radiating block | 1 | 0.996 | 0.998 | 0.985 | 0.984 | 0.984 | 0.985 | 0.957 |
| 250 nm with radiating block | 1 | 1.000 | 1.008 | 1.009 | 1.011 | 1.009 | 1.018 | 0.993 |
| | time (hour) | | | | | | | |
| | 75 | 100 | 210 | 260 | 333 | 365 | 374 | 500 |

TABLE 3-continued

| | | | | | | | | |
|---|---|---|---|---|---|---|---|---|
| 250 nm without radiating block | 0.939 | 0.912 | 0.903 | 0.880 | 0.849 | 0.818 | 0.791 | 0.773 |
| 250 nm with radiating block | 0.981 | 0.986 | 0.973 | 0.955 | 0.923 | 0.903 | 0.893 | 0.879 |

| | time (hour) | | | | |
|---|---|---|---|---|---|
| | 550 | 700 | 835 | 1010 | 1100 |
| 250 nm without radiating block | 0.737 | 0.706 | 0.680 | 0.656 | 0.652 |
| 250 nm with radiating block | 0.865 | 0.825 | 0.812 | 0.787 | 0.782 |

(Third Embodiment)

Figure 12:
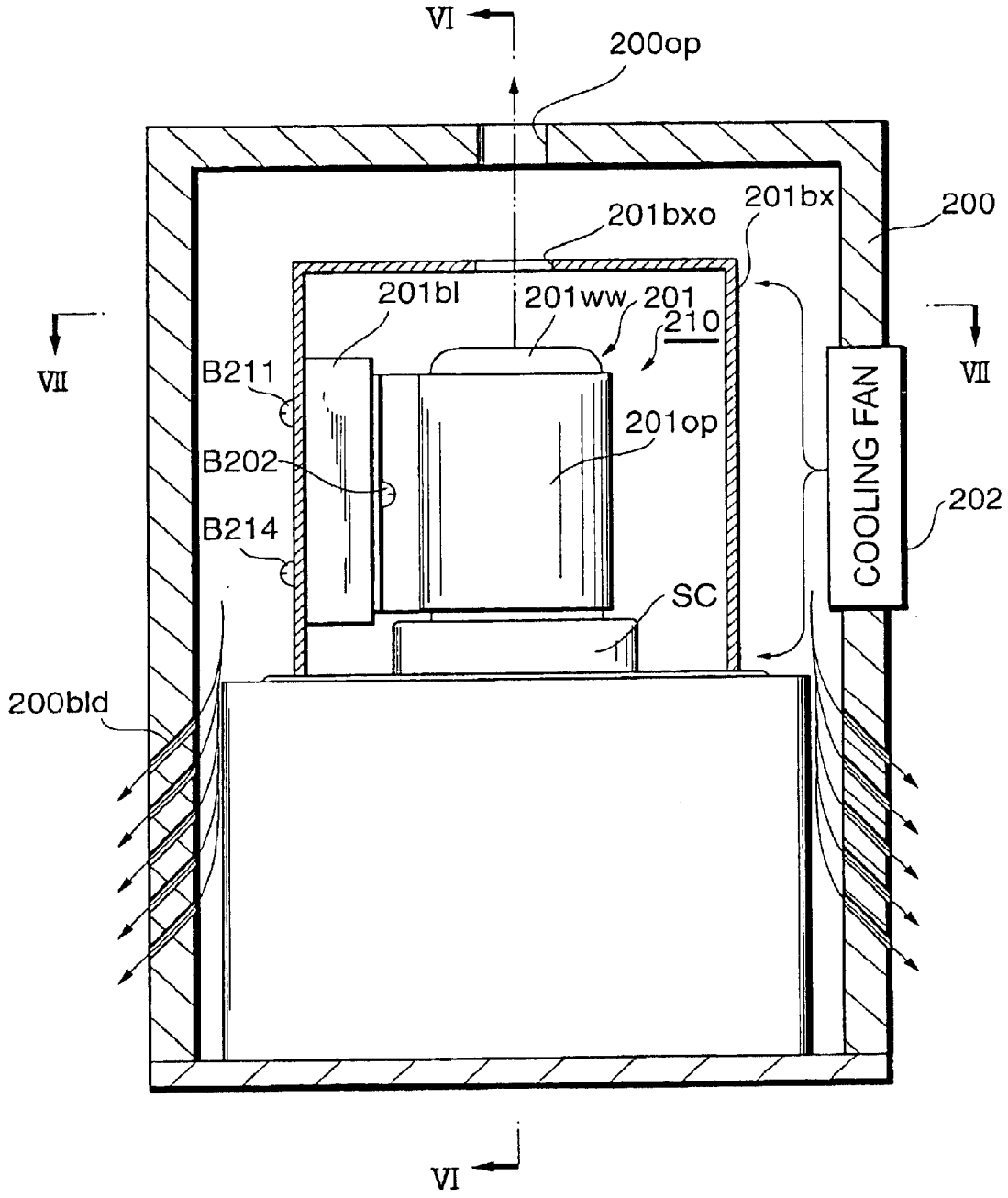
FIG. 12 is a longitudinal sectional view of the light source as a third embodiment.
Figure 13:
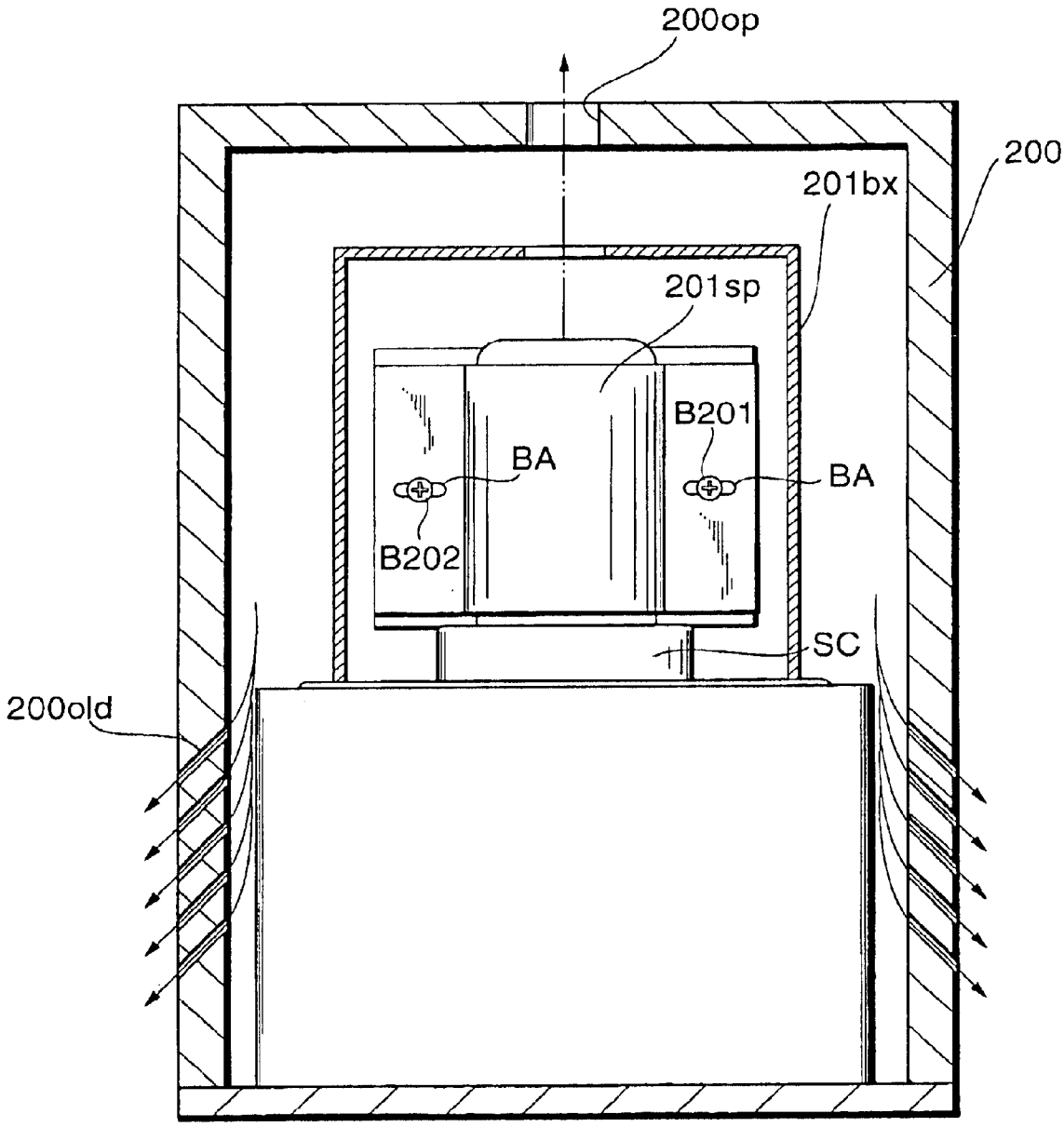
FIG. 13 is a sectional view along a line VI—VI with arrows of the light source shown in FIG. 12.
Figure 14:
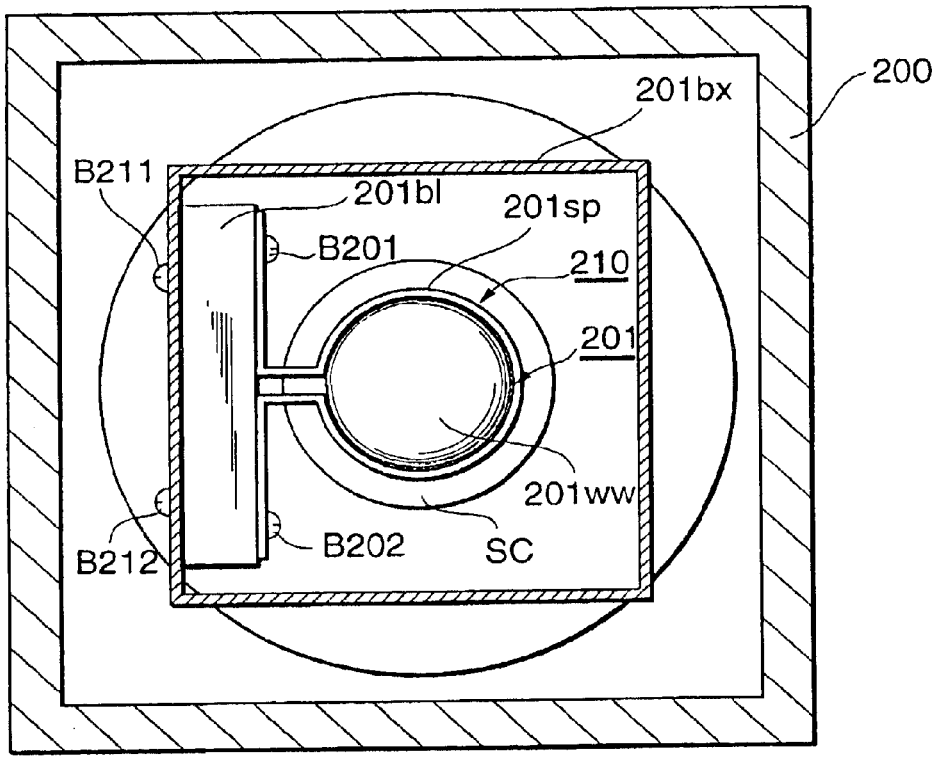
FIG. 14 is a sectional view along a line VII—VII with arrows of the light source shown in FIG. 12.
Figure 15:
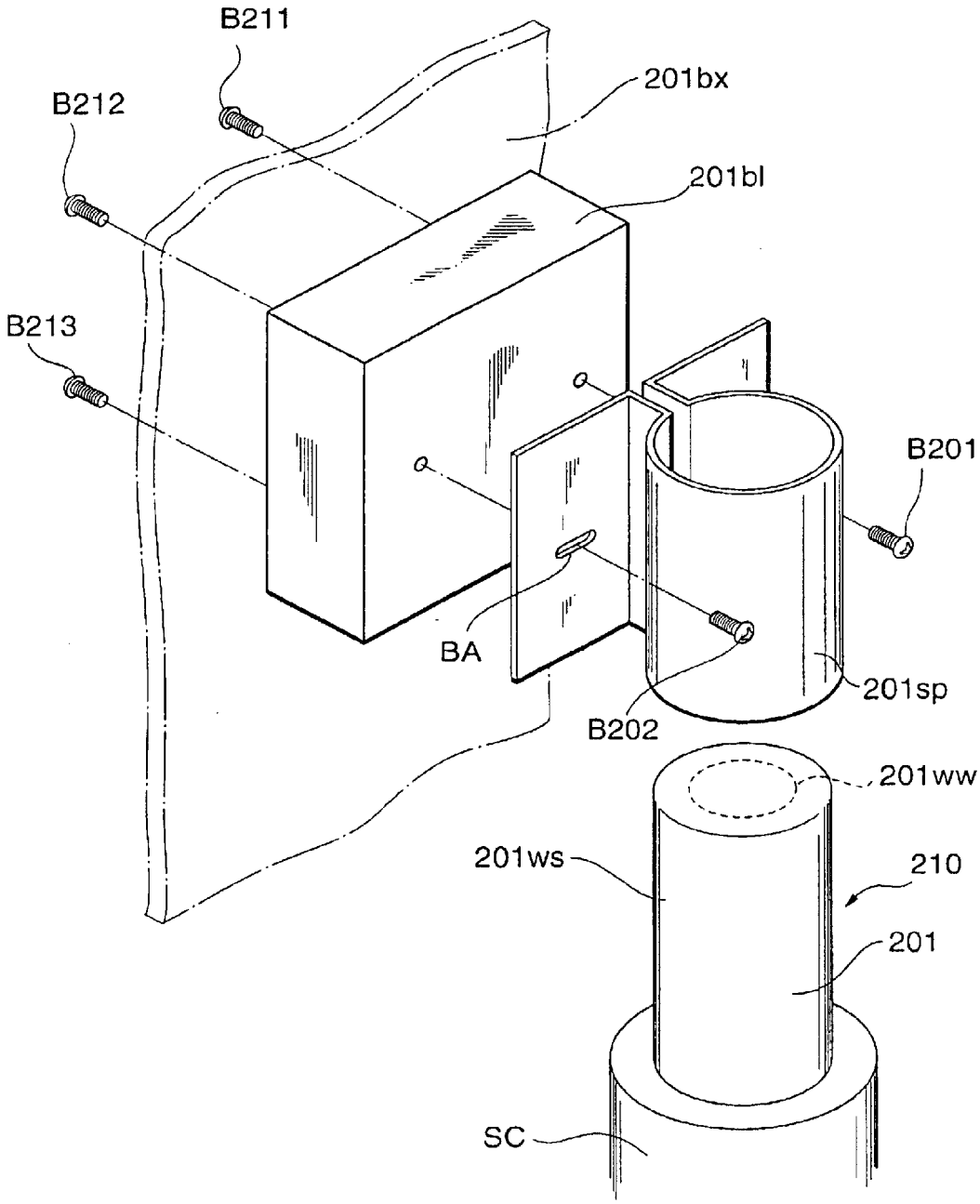
FIG. 15 is a perspective view of major part of the light source shown in FIG. 12.

FIG. 12 is a longitudinal sectional view of the light source as a third embodiment, FIG. 13 a sectional view along a line VI—VI with arrows of the light source shown in FIG. 12, FIG. 14 a sectional view along a line VII—VII with arrows of the light source shown in FIG. 12, and FIG. 15 a perspective view of major part of the light source shown in FIG. 12.

The light source of the present embodiment is different from the second embodiment in that the spring member 201*sp* surrounds the side wall of the discharge tube 210 and the block 201*bl* thermally connected therewith is not mounted on the top region of the radiator box 201*bx* but mounted on the side wall thereof.

The spring member 201*sp* will be described first. The spring member 201*sp* has an approximately cylindrical interior surface and this interior surface is in contact with the side wall of the cylindrical discharge tube envelope 201. The peripheral ends of the spring member are not connected to each other, are bent in an Ω-shaped cross section normal to the tube axis, and are fixed to the radiating block 201*bl* wit bolts B201, B202 inserted in two idle holes BA provided in the spring member 201*sp*. In a no-load state, the diameter of the cylindrical interior surface of the spring member 201*sp* is a little smaller than the diameter of the envelope 201 and this interior surface braces the peripheral region 201*ws* set on the side wall of the envelope, so as to increase the degree of adhesion between the spring member 201*sp* and the peripheral region 201*ws*.

The radiating block 201*bl* is fixed to the interior surface of the side wall of the radiator box 201*bx* with bolts B211, B212, B213, B214.

The exit window 201*ww* located in the top region of the discharge tube 210 is exposed, and rays emerging therefrom are emitted through the opening 201*bxo* of the radiator box 201*bx* and the opening 200*op* of the outer box 200 to the outside.

Since the light source of the present embodiment adopts the configuration as described, it is constructed without the foregoing radiating block 201*bl*', and the structure except for the above is the same as in the second embodiment. In the light source of the present embodiment, the spring member 201*sp* of the heat sink is able to cool the side wall 201*w* in such arrangement as to surround it, because the peripheral region 201*ws* is set on the surface of the side wall 201*w* of the discharge tube 210 so as to surround the tube axis of the discharge tube 210. In addition, since the heat sink is arranged as a unit to surround the side wall 201*w*, it can regulate movement in the directions normal to the tube axis of the discharge tube 210.

(Fourth Embodiment)

Figure 16:
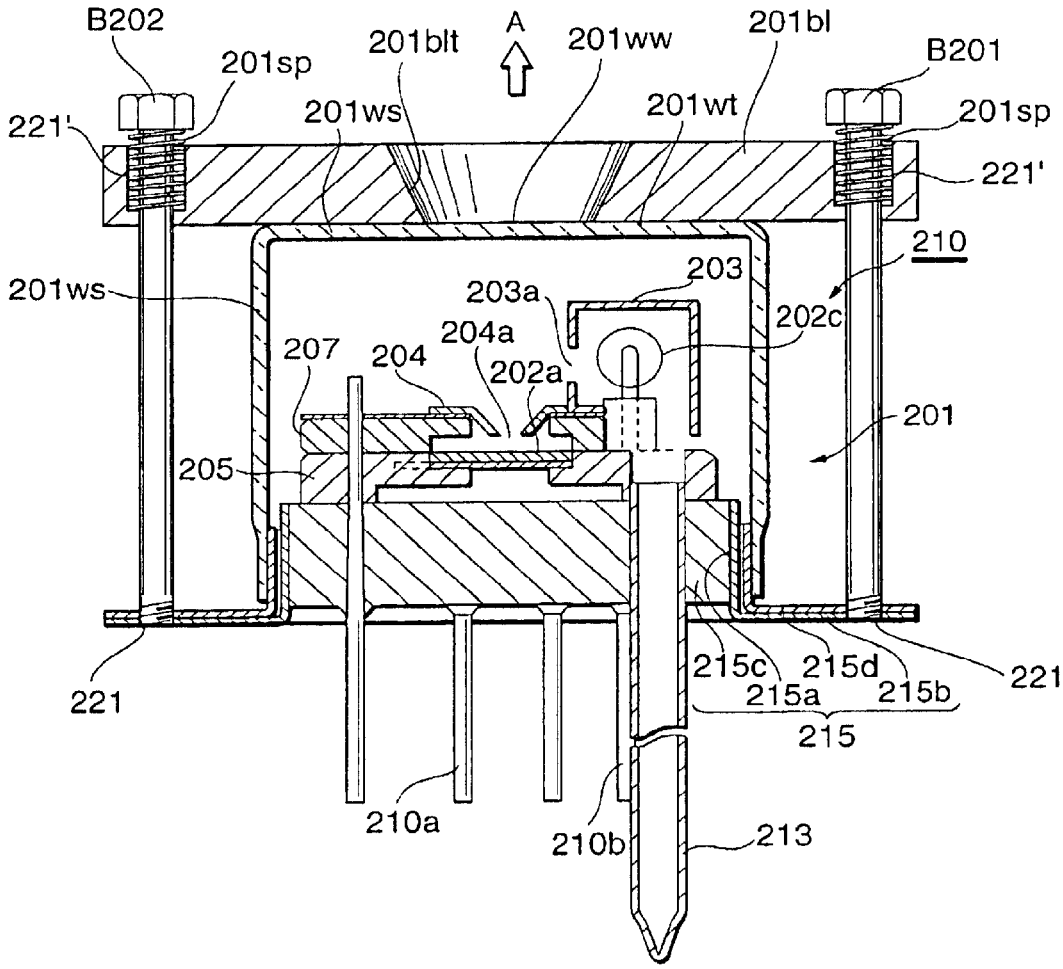
FIG. 16 is a longitudinal sectional view of the main body of the light source as a fourth embodiment.
Figure 17:
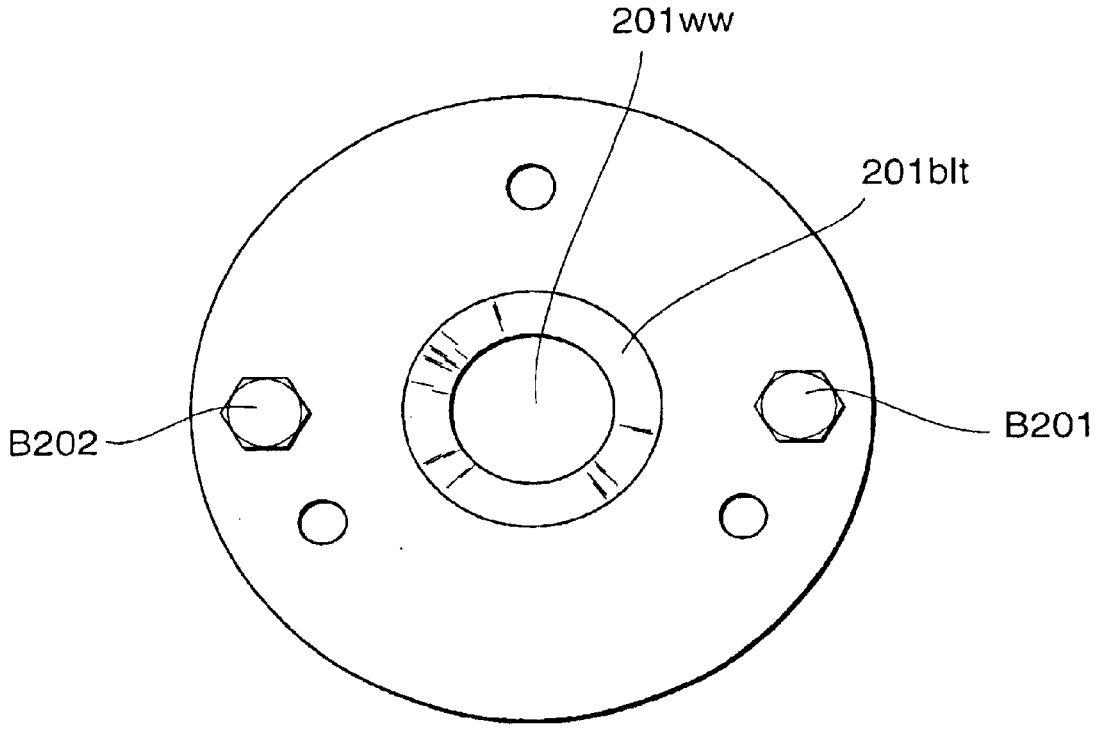
FIG. 17 is a plan view of the main body of the light source shown in FIG. 16.
Figure 18:
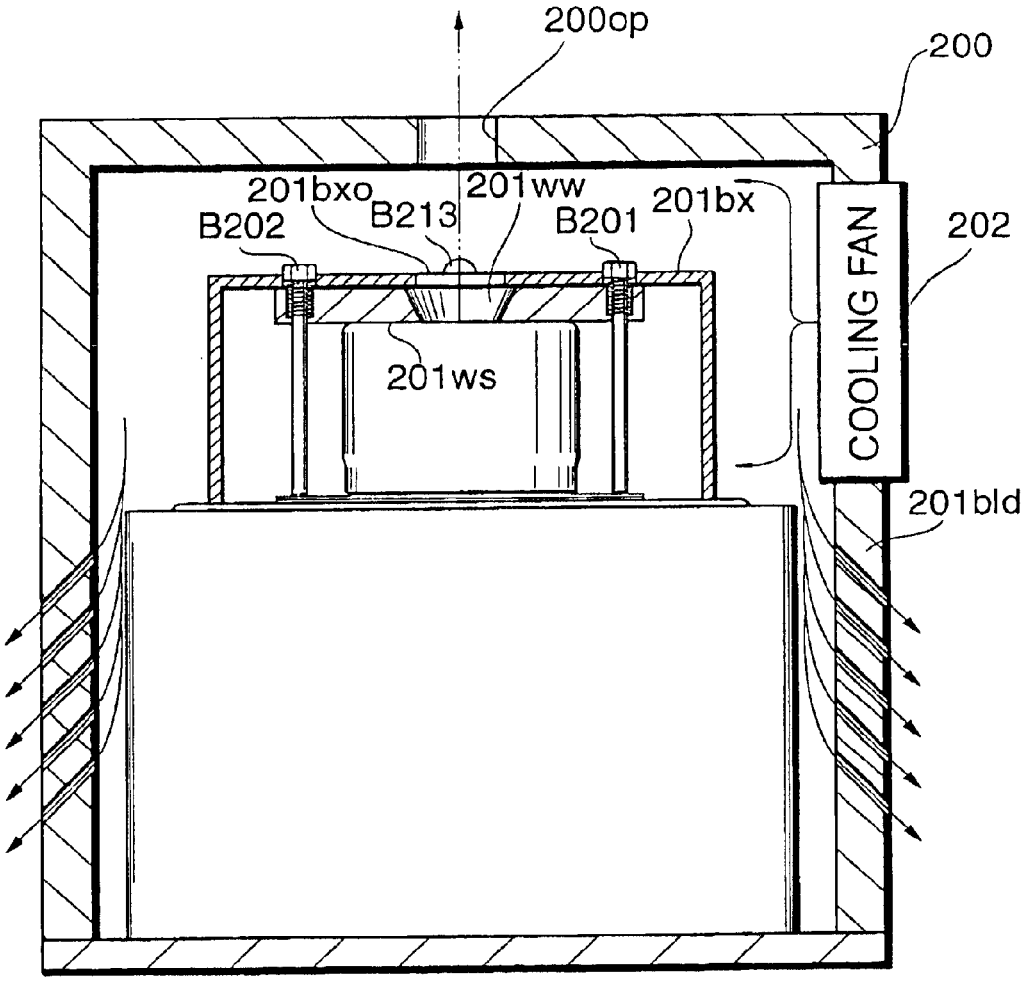
FIG. 18 is a longitudinal sectional view of the light source constructed in such structure that the main body of the light source shown in FIG. 16 is housed in a radiator box.
Figure 19:
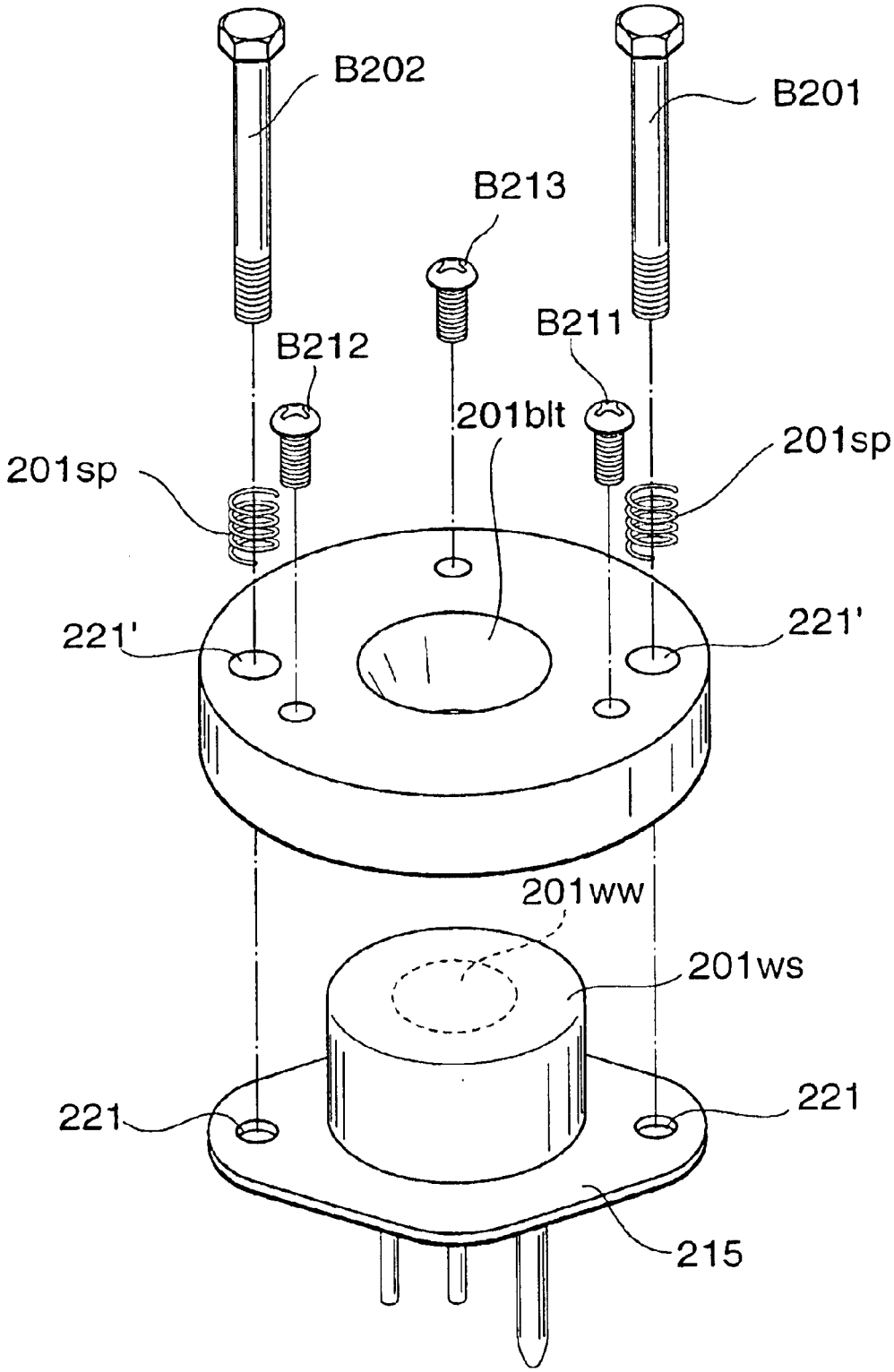
FIG. 19 is a perspective view of major part of the light source shown in FIG. 18.

FIG. 16 is a longitudinal sectional view of the main body of the light source as a fourth embodiment, FIG. 17 a plan view of the main body of the light source shown in FIG. 16, FIG. 18 a longitudinal sectional view of the light source in the structure in which the main body of the light source shown in FIG. 16 is housed in a radiator box, and FIG. 19 a perspective view of major part of the light source shown in FIG. 18.

First, the main body of the light source will be described below. The discharge tube 210 in the main body of the light source comprises an envelope 201 having a cylindrical side wall 201*ws* extending along the tube axis from the outer periphery of a cylindrical region 201*wt* constituting its top region, and the bottom part of the envelope 201 is sealed by a stem 215 having a flange portion. A gas such as deuterium or the like is sealed inside the envelope 201.

When the filament 202*c* constituting the cathode is energized, thermal electrons emitted from the filament 202*c* jump out of an opening 203*a* provided in a guide body 203, change their trajectory toward the converging electrode 204, and travel through an opening 204*a* thereof to impinge on the anode 202*a*. This discharge phenomenon induces emission of light from the gas near the opening 204*a* of the converging electrode, and the light is outputted in the direction of arrow A and through the exit window 201*ww* located in the top region of the discharge tube.

The converging electrode 204 and the anode 202*a* are insulated from each other through insulating members 207, 205, and predetermined potentials are impressed through lead pins 210*a*, 210*b*, etc. provided on the stem 215 side, on the cathode 202*c*, the anode 202*a*, and the converging electrode 204. The stem 215 is provided with a glass tube 213 communicating with the interior of the envelope, and the terminal end thereof is closed. The glass tube 213 is used in order to introduce the gas into the envelope 201 in the production process.

The stem 215 consists of a columnar glass block 215*c*; a base portion consisting of a cylinder body 215*a* having a cylindrical inside surface fixed in close fit with a cylindrical surface of the side wall of the glass block 215*c* and a flange portion 215*b* bent from the lower opening end face of the cylinder body 215*a* to the outside; and a seal member 215*d* interposed between the base portion and the internal surface of the side wall 201*ws* of the envelope. The base portion and seal member 215*d* are made of a metal such as SUS, kovar, or the like, and the flange portion 215*b* is provided with a plurality of holes 221 parallel to the tube axis. Since in the present example the seal member 215*d* extends up to the flange portion 215*b*, the holes 221 also penetrate the seal member 215*d*.

The radiating block 201*bl* is in contact with a circular region 201*wt* constituting the top region of the envelope. In other words, the opening 201*blo* of the radiating block is provided with a through hole 201*blt* extending in parallel with the tube axis, the end face of the opening is in contact with the peripheral region 201*ws* around the exit window 201*ww*, and the light through the exit window 201*ww* is outputted through the opening.

The peripheral part of the radiating block 201*bl* is provided with fixing holes 221' parallel to the tube axis, and the bolts B201, B202 establish connection and fixing between the holes 221' and the holes 221 of the stem. In detail, thread grooves are formed in the flange 215*d* of the stem 215, and thread ridges of the bolts B201, B202 are meshed with the thread grooves, whereupon the radiating block 201*bl* is fixed to the stem 215. The longitudinal direction of the bolts B201, B202 agrees with the tube axis. The holes 221' of the radiating block 201*bl* are set in two stages of diameters, and the diameter more distant from the stem 215 is greater than that nearer. Spiral spring members 201*sp* are placed in the larger diameter portions of the holes 221'. As the bolts B201, B202 are screwed, the radiating block 201*bl* is pushed toward the peripheral region 201*ws* by restoring force of the spring members 201*sp*, so that the peripheral region 201*ws* is urged by the radiating block 201*bl*. Accordingly, the degree of adhesion is enhanced between the peripheral region 201*ws* and the radiating block 201*bl*.

When the main body of the light source is assembled in the radiator box, as shown in FIG. 18, the spring members 201*sp* are interposed between the wall located in the top region of the radiator box 201*bx*, and the radiating block 201*bl*, and the bolts B201, B202 are inserted from the outside of the radiator box 201*bx*. The radiating block 201*bl* and the interior surface of the radiator box 201*bx* are fixed to each other with bolts B211, B212, B213.

The light emitted through the exit window 201*ww* of the discharge tube 210 is outputted through the through hole 201*blt* of the radiating block, the through hole 201*bxo* of the radiator box, and the through hole 200*op* of the outer box 200 to the outside. A cooling fan 202 is mounted on the outer box 200 as in the previous embodiments, and air introduced into the interior by the cooling fan 202 cools the inner box 201*bx* and then flows through vent holes 201*bld* to the outside. When the inner box 201*bx* is cooled, the peripheral region 201*ws* in contact with the radiating block 201*bl* is also cooled.

In the present example, the deposition of materials on the exit window 201*ww* is also efficiently restrained similarly as in the previous embodiments, the discharge tube 210 has the stem 215 constituting the bottom part of the envelope 201, and the stem 215 is fixed to the heat sink 201*bx*, 201*bl*, 201*sp* through the plurality of bolts (screws) B201, B202 extending in parallel with the tube axis. Since the stem 215 is utilized for the fixing of the heat sink, it is feasible to suppress increase in the number of components necessary for the fixing.

(Fifth Embodiment)

Figure 20:
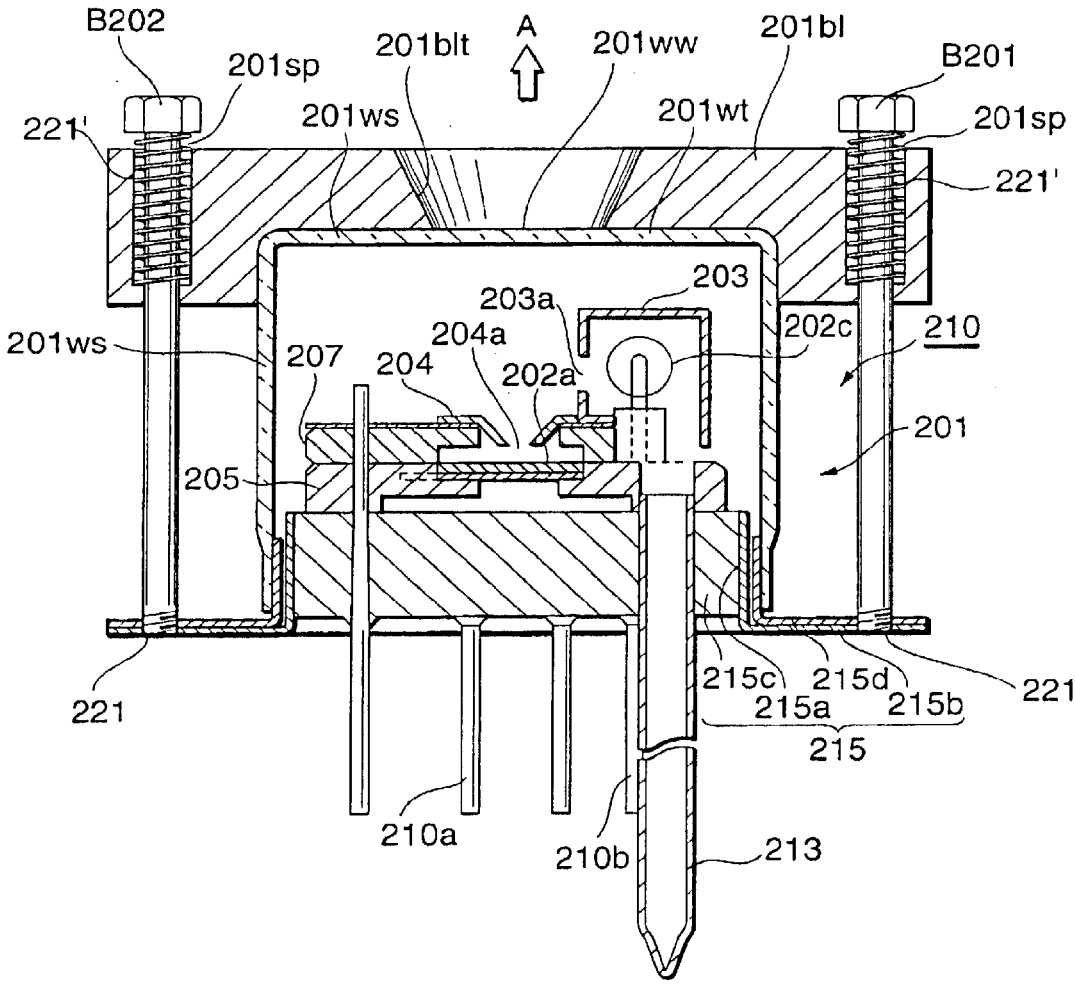
FIG. 20 is a longitudinal sectional view of the main body of the light source as a fifth embodiment.
Figure 21:
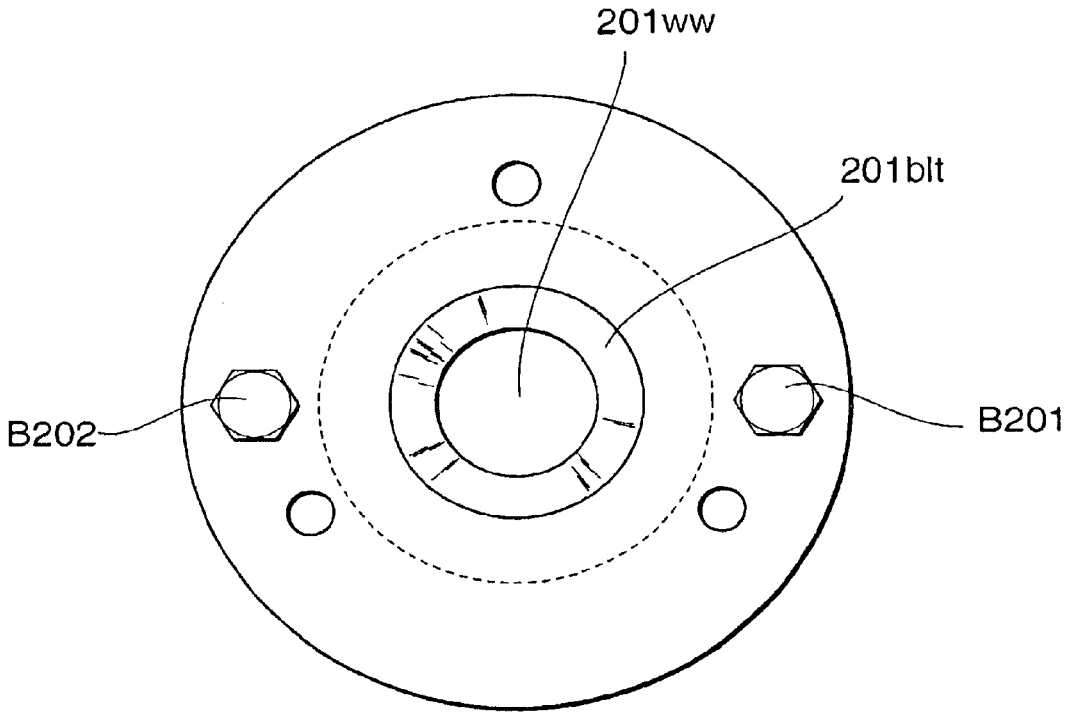
FIG. 21 is a plan view of the main body of the light source shown in FIG. 20.
Figure 22:
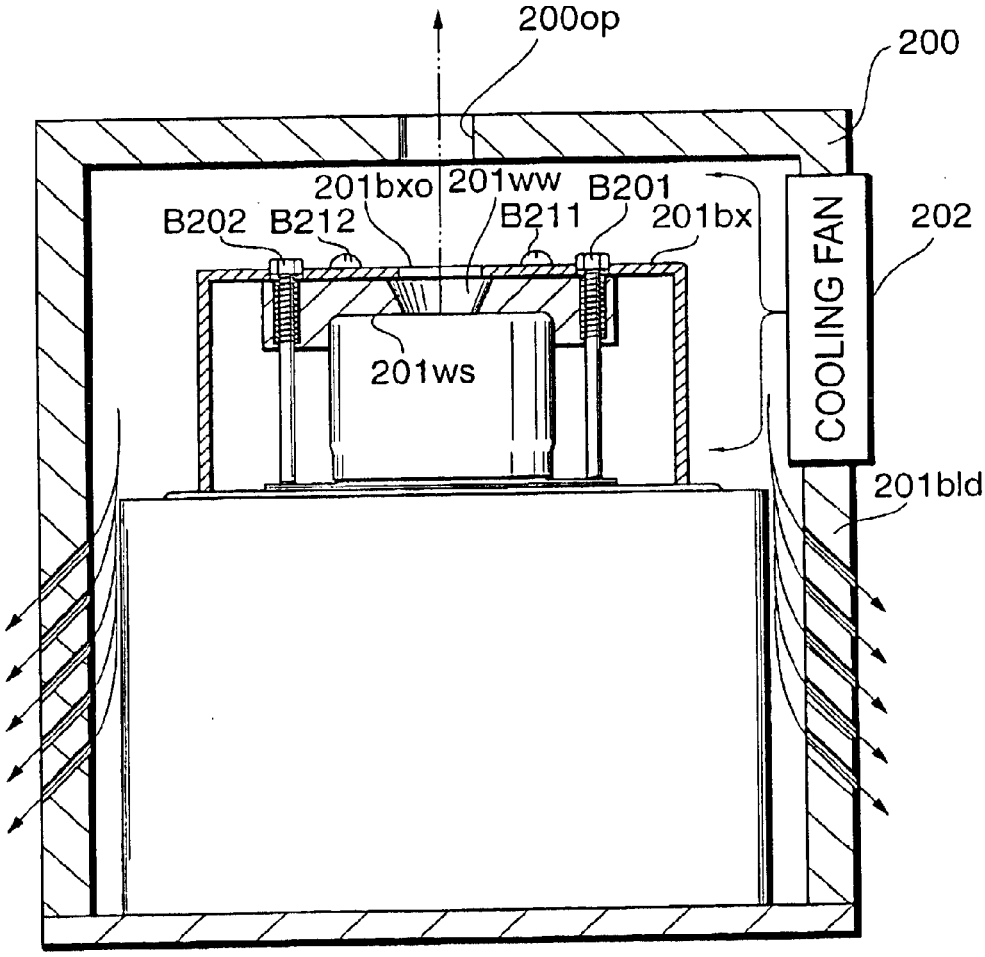
FIG. 22 is a longitudinal sectional view of the light source constructed in such structure that the main body of the light source shown in FIG. 20 is housed in a radiator box.
Figure 23:
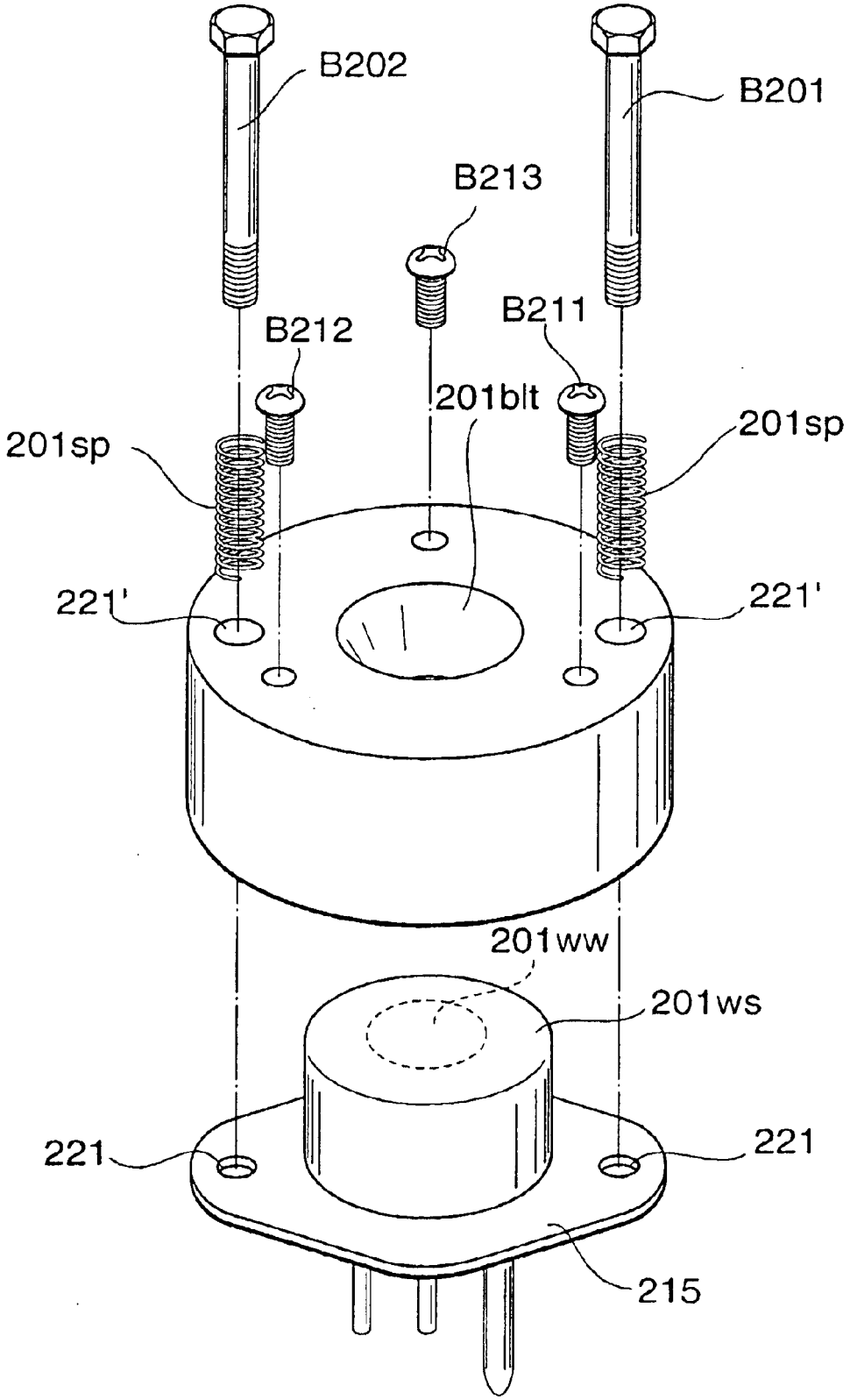
FIG. 23 is a perspective view of major part of the light source shown in FIG. 20.

FIG. 20 is a longitudinal sectional view of the main body of the light source as a fifth embodiment, FIG. 21 a plan view of the main body of the light source shown in FIG. 20, FIG. 22 a longitudinal sectional view of the light source in the structure in which the main body of the light source shown in FIG. 20 is housed in a radiator box, and FIG. 23 a perspective view of major part of the light source shown in FIG. 20.

The light source of the present embodiment is different only in the shape of the radiating block 201*bl* from the fourth embodiment, but is identical in the other structure. Specifically, the radiating block 201*bl* is in contact with both the circular region 201*wt* constituting the top region of the discharge tube 210, and the side face 201*ws*.

In detail, the radiating block 201*bl* in direct contact with the discharge tube 210 is of such shape as to cover the top region of the envelope 201 of the discharge tube 210. The outer surface of the top region of the envelope 201 consists of a circular surface 201*wt* and a side face of cylindrical shape 201*ws* extending continuously from the outer periphery of the circular surface 201*wt* and in the direction normal to the circular surface by approximately 20 or less % of the tube length. The radiating block 201*bl* is not in contact with a region in a predetermined radius from the center of the circular surface 201*wt*, and this region functions as the exit window 201*ww*. Namely, the central region of the ring-shaped radiating block 201*bl* constitutes the through hole 201*blt* extending in parallel with the tube axis, the discharge-tube-side end of the through hole 201*blt* located inside the radiating block 201*bl* is in contact with the peripheral region 201*ws* around the circular surface 201*wt*, and the block expands its diameter from the contact position to the diameter of the envelope 201 to then extend in parallel with the tube axis.

As described above, the light source in each of the above embodiments comprises the discharge tube 210 in which the gas such as deuterium or the like is sealed in the envelope 201 and in which the discharge is induced between the pair of electrodes 202*a*, 202*c* disposed inside the envelope, to emit light from the gas between the electrodes 202*a*, 202*c* and output the light through the exit window 201*ww* located in the top region of the envelope 201, to the outside, and the heat sink is in contact with the surface of the peripheral region 201*ws* around the exit window 201*ww*. In these light sources, the light is outputted through the exit window 201*ww* to the outside, and the peripheral region 201*ws* is cooled by the heat sink in contact with the surface of the peripheral region 201*ws* around the exit window 201*ww*. Accordingly, the materials made by sputtering or the like of the pair of electrodes 202*c*, 202*a* constituting the cathode or the anode, mostly attach to the peripheral region 201*ws*, so as to decrease the amount of materials attaching to the exit window 201*ww* and thus extend the lifetime of the discharge tube.

(Sixth Embodiment)

Figure 24:
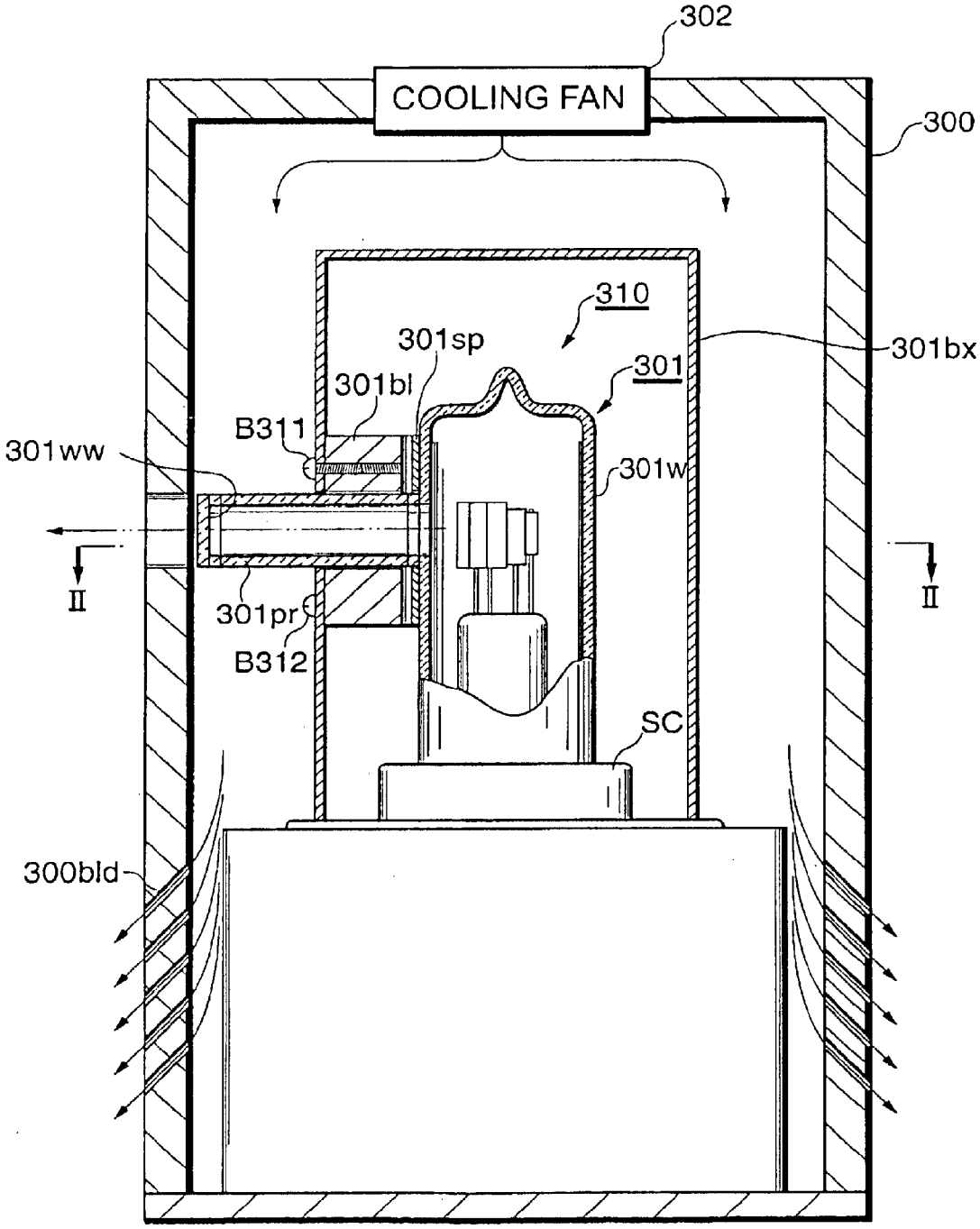
FIG. 24 is a longitudinal sectional view of the light source as a sixth embodiment.
Figure 25:
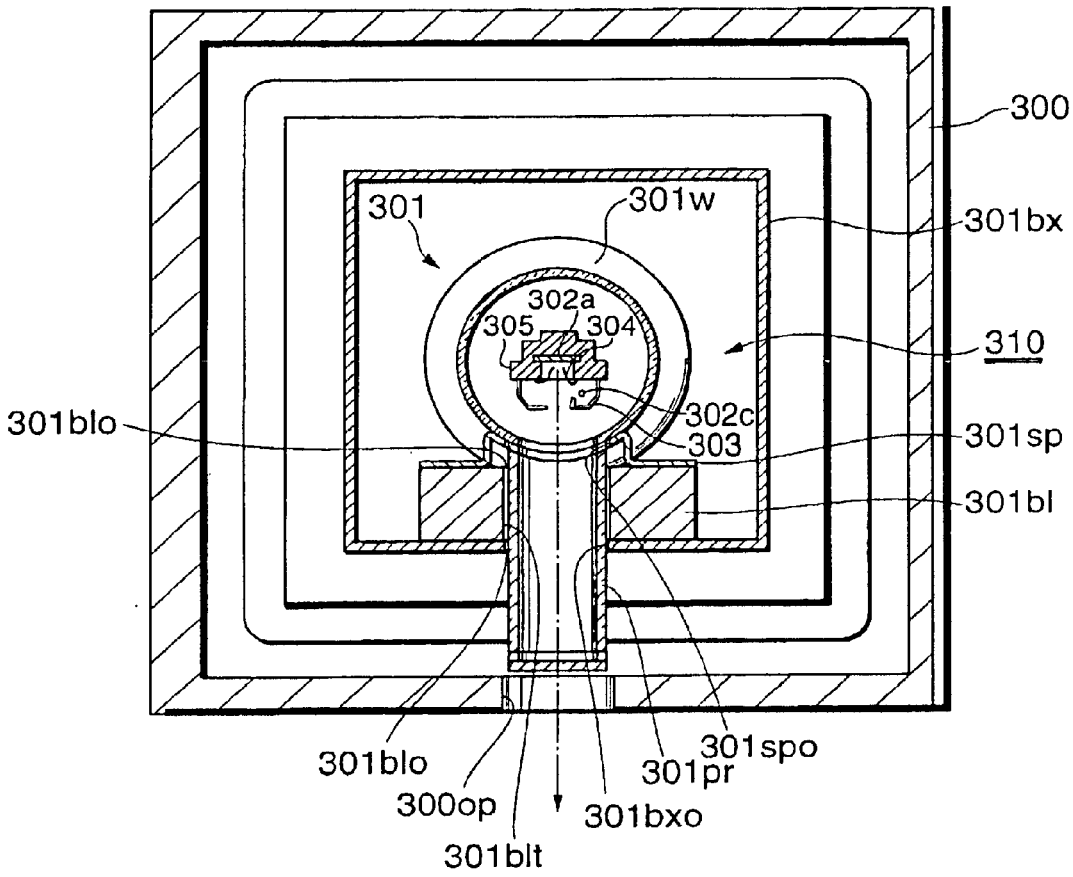
FIG. 25 is a sectional view along a line II—II with arrows of the light source shown in FIG. 24.
Figure 26:
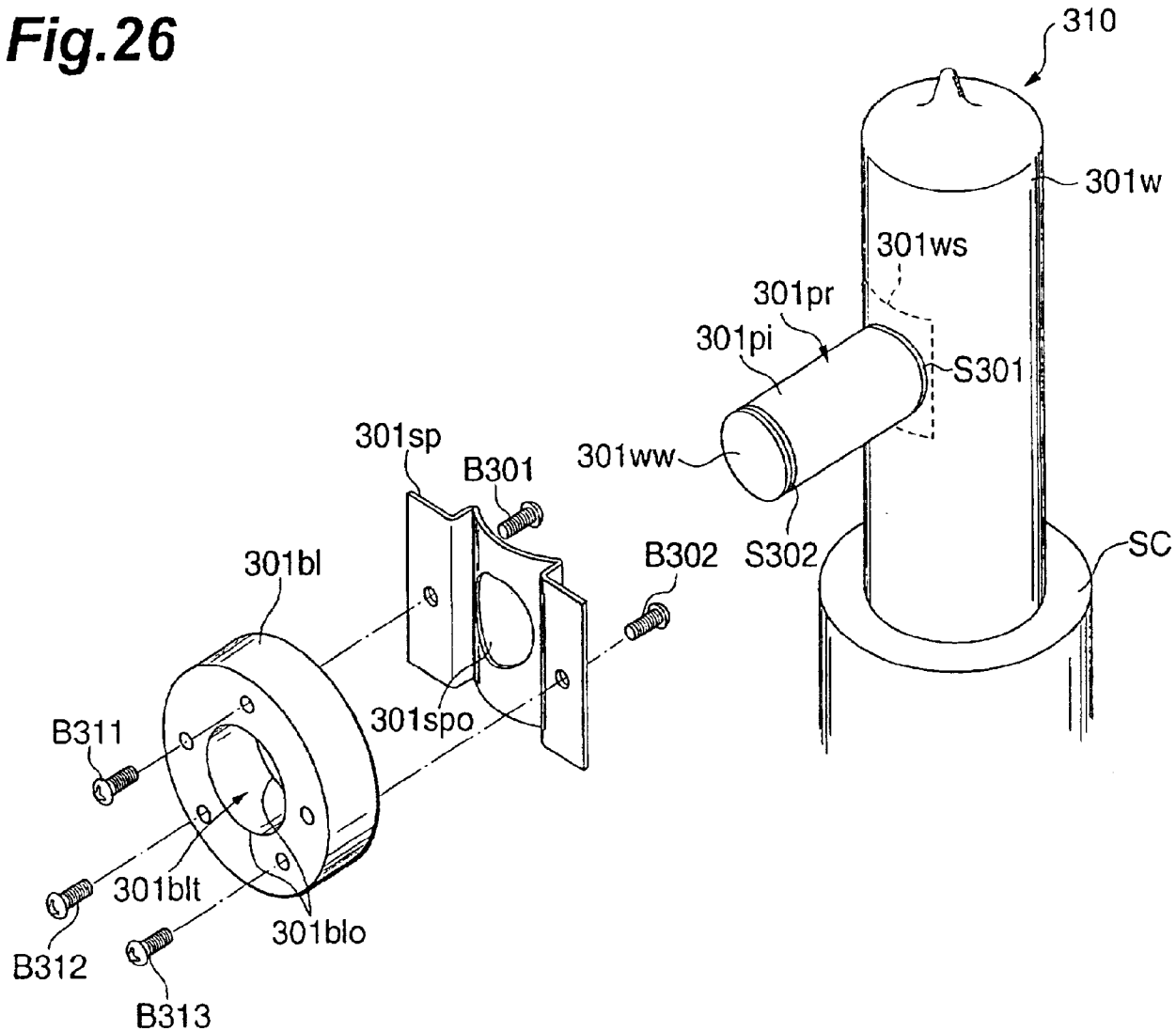
FIG. 26 is a perspective view of major part of the light source shown in FIG. 24.

FIG. 24 is a longitudinal sectional view of the light source as a sixth embodiment, FIG. 25 a sectional view along a line II—II with arrows of the light source shown in FIG. 24, and FIG. 26 a perspective view of major part of the light source shown in FIG. 24.

The light source of the present embodiment comprises an outer box 300, an inner box (radiator box) 301*bx* housed in the outer box 300, and a discharge tube 310 placed in the inner box 301*bx*. The discharge tube 310 is mounted on a socket SC fixed to a bottom plate of the inner box 301*bx*, and the exterior surface of the inner box 301*bx* is cooled by a cooling fan 302 disposed in the top region of the outer box 300. Air taken in from the cooling fan 302 flows through vent holes 300*bld* formed in the side wall of the outer box 300, to the outside.

The deuterium discharge tubes suffer degradation of stability of light output because of fluctuation of outside air temperature, whereas the present embodiment is configured to let air flow between the inner box 301*bx* and the outer box 300 so as to avoid the flowing air directly hitting the deuterium discharge tube, thereby preventing the degradation of stability of output.

The discharge tube 310 comprises an airtight envelope (glass bulb) 301 having a cylindrical side wall 301*w*. A gas such as deuterium or the like is sealed in the envelope 301 so as to emit ultraviolet light as output light. When the discharge is induced between a pair of electrodes 302*c*, 302*a* placed inside the envelope 301, light is emitted from the gas between the electrodes 302*c*, 302*a* and is outputted through an exit window 301*ww* to the outside.

Specifically, a projecting portion 301*pr* extends in the direction normal to the tube axis of the bulb from a predetermined portion of the side wall 301*w* of the envelope, and the distal end of the projecting portion 301*pr* constitutes the exit window 301*ww*. The projecting portion 301*pr* is constructed in the structure wherein a hole is bored in the side wall 301*w*, a glass pipe 1*pi* is connected through a seal ring S301 of glass thereto so as to establish communication therewith, and an opening located at the distal end of the glass pipe 1*pi* is sealed through a seal ring S302 of glass with a window material 301*ww*. The light generated inside the discharge tube is outputted through the exit window of this window material 301*ww* to the outside.

A heat sink consisting of a radiating block 301*bl* and a radiating spring member 301*sp* is in contact with a surface of a peripheral region 301*ws* around the aforementioned predetermined portion. The peripheral region 301*ws* is a surface region of the side wall 301*w* located in the root part of the projecting portion 301*pr*. The discharge tube 310 is positioned inside the radiator box 301*bx* and the outer box 300 for stable light emission, and the radiator box 301*bx* is thermally connected to the heat sink 301*sp*, 301*bl*, whereby the radiator box 301*bx* absorbs heat through the heat sink 301*sp*, 301*bl* from the discharge tube 310 and efficiently radiates the heat to the outside, so as to increase the cooling efficiency of the peripheral region 301*ws*.

The radiating spring member 301*sp* will be described below in detail. The spring member 301*sp* has an inwardly concave cylindrical surface, which is in contact with the surface of the peripheral region 301*ws* constituting an outwardly convex cylindrical surface. The radius of curvature of the cylindrical surface of the spring member 301*sp* in a no-load state is larger than that of the side wall 301*w* of the discharge tube. As the spring member 301*sp* is pressed against the side wall 301*w*, the spring member 301*sp* is elastically deformed so as to decrease the radius of curvature of the spring member. In the elastically deformed state, the two ends of the spring member 301*sp* in the direction along the curvature thereof hold the side face 301*w* between, and the central region of the curvature urges the side face 301*w* in the direction normal to the tube axis of the discharge tube 310. The bottom part of the discharge tube 310 is fixed to the socket SC, and the spring member 301*sp* urges the side face 301*w* everywhere, so as to increase the degree of adhesion between the spring member 301*sp* and the peripheral region 301*ws* of the cylindrical side wall.

The spring member 301*sp* has an opening 301*spo* in which the projecting portion 301*pr* is inserted and through which the output light from the discharge tube 310, propagating in the projecting portion 301*pr*, passes. The radiating block 301*bl* has two parallel planes facing each other, and has a projecting-portion-inserting through hole 301*blt* penetrating the block 301*bl* so as to establish communication between openings 301*blo* formed in these two planes. Accordingly, the radiating block 301*bl* is of such ring shape as to surround the through hole 301*blt*. Furthermore, the inner box 301*bx* has a light-exiting opening 301*bxo* in its side wall.

The spring member 301*sp* and the ring radiating block 301*bl* are fixed to each other with bolts B1, B2 so that their respective openings 301*spo*, 301*blo* are aligned with each other. The radiating block 301*bl* and the interior surface of the side wall of the inner box 301*bx* are fixed to each other with bolts B311, B312, B313 so that their respective openings 301*blo*, 301*bxo* are aligned with each other. These openings 301*blo*, 301*bxo* are aligned with an opening 300*op* provided in the side wall of the outer box 300.

In the light source, the light is outputted through the exit window 301*ww* to the outside of the discharge tube, and the light in the discharge tube 310 is outputted through the openings 301*spo*, 301*blo*, 301*bxo*, 300*op* to the outside of the outer box 300. Since the heat sink is in contact with the surface of the peripheral region 301*ws*, the peripheral region 301*ws* is cooled. Accordingly, the materials made by sputtering or the like of the electrode 302*c* for the cathode or the electrode 302*a* for the anode, mostly attach to the peripheral region 301*ws* of the side wall 301*w*, so as to decrease the amount of materials attaching to the exit window 301*ww*. Namely, the exit window 301*ww* is kept clean over a long period of time, so that the lifetime of the discharge tube can be lengthened.

The heat sink may be arranged in contact with the region other than the exit window 301*ww* of the glass pipe 301*pi*, i.e., the projecting portion 301*pr*.

The discharge tube 310 is conventionally known, and it will be briefly described with reference to FIG. 25. Inside the envelope 301 having the side wall 301*w*, as described above, there are the two electrodes 302*c*, 302*a*, one of which is the cathode 302*c* of a filament and the other of which is the anode 302*a* for collecting thermal electrons generated during energization of the filament 302*c*. The filament 302*c* is placed inside a metal shield 303 surrounding it, and the thermal electrons generated at the filament 302*c* travel through an opening of the shield 303 and toward a converging electrode 304 and are curved in trajectory by the shield 303 and converging electrode 304 to impinge on the anode 302*a*. The shield 303 is mounted on the light exit side of an insulator 305, and the anode 302*a* on the light entrance side of the insulator 305. Thus the shield 303 and the anode 302*a* are insulated from each other, and the shield 303 and the filament 302*c* are also insulated from each other.

When the gas sealed in the envelope 301 contains deuterium, the discharge tube 310 functions as a deuterium discharge tube. The deuterium discharge tube has a low rate of temperature rise on the surface of the tube, different from the xenon lamps filled with xenon under high pressure. In the lamp of the above configuration the temperature difference is smaller between the cooled region 301*ws* by the heat sink and the non-cooled region 301*ww* than in the xenon lamps, which suppresses the deterioration of the side wall 301*w* due to the temperature difference.

The present invention can also be applied to the xenon flash tubes and mercury xenon tubes with xenon in the envelope 301, and the electrode 302*c* does not always have to be the filament.

As described above, the materials made by sputtering or the like of the electrode 302*c* for the cathode or the electrode 302*a* for the anode, mostly attach to the peripheral region 301*ws* of the side wall 301*w* or the glass pipe 301*pr*, so that the exit window 301*ww* is kept clean over a long period of time, so as to lengthen the lifetime of the discharge tube. The projecting portion 301*pr* may be provided in the top region of the envelope 301.

INDUSTRIAL APPLICABILITY

The present invention can be applied to lamps having the discharge tube, such as the deuterium discharge tube, the xenon flash tube, or the like.

What is claimed is:

1. A light source comprising a discharge tube in which a gas is sealed in an envelope having a cylindrical side wall of glass and in which discharge is induced between a pair of electrodes placed inside the envelope, to emit light from the gas between the electrodes and output the light through an exit window of the side wall to the outside, wherein a heat sink having an opening surrounding the optical axis of the light outputted through said exit window is in contact with a glass surface of a peripheral region around said exit window.

2. The light source according to claim 1, wherein said discharge tube is placed in a radiator box and said radiator box is thermally connected to said heat sink.

3. The light source according to claim 1, wherein said heat sink comprises a spring member which is elastically deformed to contact said cylindrical side wall.

4. The light source according to claim 1, wherein one of said electrodes is a cathode of a filament, the other of said electrodes is an anode for collecting thermal electrons generated during energization of said filament, and the gas sealed in the envelope contains deuterium.

5. A light source comprising a discharge tube in which a gas is sealed in an envelope and in which discharge is induced between a pair of electrodes placed inside said envelope, to emit light from the gas between the electrodes and output the light through an exit window located in a top region of said envelope, to the outside, wherein a heat sink is in contact with a surface of a peripheral region around said exit window, and wherein said heat sink is in contact with said envelope so that said peripheral region is located at least in the top region of said envelope.

6. The light source according to claim 5, wherein said heat sink is in contact with said envelope so that said peripheral region is also located on a side wall of said envelope.

7. The light source according to claim 5, wherein said discharge tube has a stem constituting a bottom region of said envelope and wherein said stem is fixed to said heat sink through a plurality of bolts extending in parallel with the axis of the tube.

8. The light source according to claim 5, wherein said peripheral region is set on a surface of a side wall of said discharge tube so as to surround the tube axis of said discharge tube.

9. The light source according to claim 5, wherein one of said electrodes is a cathode of a filament, the other of said electrodes is an anode for collecting thermal electrons generated during energization of said filament, and the gas sealed in the envelope contains deuterium.

10. A light source comprising a discharge tube in which a gas is sealed in an envelope of glass and in which discharge is induced between a pair of electrodes placed inside said envelope, to emit light from the gas between said electrodes and output the light through an exit window located at a distal end of a projecting portion communicating with a predetermined portion of said envelope, to the outside, wherein a heat sink having an opening surrounding the optical axis of the light outputted through said exit window is in contact with a peripheral region around said predetermined portion or a glass surface except for said exit window of said projecting portion.

* * * * *